US011503968B2

(12) United States Patent
Freese et al.

(10) Patent No.: US 11,503,968 B2
(45) Date of Patent: Nov. 22, 2022

(54) SYSTEM AND METHOD FOR REDUCING NOISE AND/OR VIBRATION IN A CLEANING APPARATUS WITH COMBING UNIT FOR REMOVING DEBRIS

(71) Applicant: SHARKNINJA OPERATING LLC, Needham, MA (US)

(72) Inventors: John B. Freese, Chestnut Hill, MA (US); Tyler S. Smith, Boston, MA (US); Wenxiu Gao, Suzhou (CN); Ian Liu, Suzhou (CN); Nicholas Sardar, London (GB)

(73) Assignee: SharkNinja Operating LLC, Needham, MA (US)

( * ) Notice: Subject to any disclaimer, the term of this patent is extended or adjusted under 35 U.S.C. 154(b) by 277 days.

(21) Appl. No.: 16/536,901

(22) Filed: Aug. 9, 2019

(65) Prior Publication Data

US 2020/0046184 A1 Feb. 13, 2020

Related U.S. Application Data

(60) Provisional application No. 62/851,294, filed on May 22, 2019, provisional application No. 62/717,309, filed on Aug. 10, 2018.

(51) Int. Cl.

| | |
|---|---|
| ***A47L 9/00*** | (2006.01) |
| ***A47L 9/04*** | (2006.01) |
| ***A47L 9/06*** | (2006.01) |

(52) U.S. Cl.

CPC ..... *A47L 9/0081* (2013.01); *A47L 9/04* (2013.01); *A47L 9/06* (2013.01)

(58) Field of Classification Search

CPC ..... A46B 13/001; A46B 13/006; A47L 5/30; A47L 9/0072; A47L 9/0081; A47L 9/02;

(Continued)

(56) References Cited

U.S. PATENT DOCUMENTS

| | | | | |
|---|---|---|---|---|
| 9,072,416 | B2 * | 7/2015 | Kowalski | A47L 9/0494 |
| 9,144,356 | B2 * | 9/2015 | Yun | A47L 9/1683 |

(Continued)

FOREIGN PATENT DOCUMENTS

| | | |
|---|---|---|
| EP | 3250102 | 1/2022 |
| JP | S58-115149 | 8/1983 |

(Continued)

OTHER PUBLICATIONS

PCT Search Report and Written Opinion dated Oct. 29, 2019, received in PCT Application No. PCT/US19/45936, 11 pgs.

(Continued)

*Primary Examiner* — Marc Carlson
(74) *Attorney, Agent, or Firm* — Grossman Tucker Perreault & Pfleger, PLLC

(57) ABSTRACT

A cleaning apparatus may include at least one isolator configured to absorb mechanical vibration generated by contact between an agitator and a combining unit to reduce noise and/or vibration. The isolator may include at least one combing isolator disposed at least partially between the combing unit and the surface cleaning head. Alternatively (or in addition), the isolator may include a panel isolator disposed at least partially between a housing of the cleaning apparatus and a panel.

18 Claims, 31 Drawing Sheets

(58) Field of Classification Search
CPC . A47L 9/04; A47L 9/0477; A47L 9/06; A47L 9/28; A47L 9/30
See application file for complete search history.

(56) References Cited

U.S. PATENT DOCUMENTS

| | | | | |
|---|---|---|---|---|
| 9,192,273 | B2 * | 11/2015 | Eriksson | A47L 11/4041 |
| 9,265,394 | B2 * | 2/2016 | Van Der Kooi | A47L 9/0626 |
| 9,295,362 | B2 * | 3/2016 | Eriksson | A47L 9/0477 |
| 9,314,140 | B2 * | 4/2016 | Eriksson | A46B 13/006 |
| 9,775,477 | B2 * | 10/2017 | Eriksson | A47L 9/0477 |
| 9,820,626 | B2 * | 11/2017 | Eriksson | A46B 13/006 |
| 10,117,553 | B2 * | 11/2018 | Eriksson | A47L 9/02 |
| 10,925,447 | B2 * | 2/2021 | Der Marderosian | A47L 11/4094 |
| 11,076,731 | B2 * | 8/2021 | Park | A47L 9/02 |
| 2001/0042282 | A1 * | 11/2001 | Sjogreen | A47L 11/4055 15/322 |
| 2008/0289138 | A1 * | 11/2008 | Yang | A47L 9/04 15/326 |
| 2009/0223008 | A1 * | 9/2009 | Kissel, Jr. | A46B 15/00 15/179 |
| 2009/0229075 | A1 * | 9/2009 | Eriksson | A46B 13/006 15/48 |
| 2010/0313912 | A1 * | 12/2010 | Han | A47L 11/33 134/21 |
| 2013/0007982 | A1 | 1/2013 | Yun | |
| 2013/0198995 | A1 * | 8/2013 | Eriksson | A47L 9/2894 15/383 |
| 2013/0232703 | A1 * | 9/2013 | Jang | A47L 11/4044 15/21.1 |
| 2014/0026338 | A1 | 1/2014 | Kim et al. | |
| 2014/0259521 | A1 * | 9/2014 | Kowalski | A47L 5/30 15/383 |
| 2014/0359968 | A1 * | 12/2014 | Eriksson | A47L 9/0494 15/390 |
| 2015/0265119 | A1 * | 9/2015 | Kowalski | A47L 9/0477 15/354 |
| 2015/0289735 | A1 * | 10/2015 | Van Der Kooi | A47L 9/02 15/383 |
| 2015/0359396 | A1 * | 12/2015 | Yun | A47L 9/1683 15/49.1 |
| 2016/0220082 | A1 * | 8/2016 | Thorne | A47L 9/0444 |
| 2016/0220084 | A1 * | 8/2016 | Xu | A47L 9/0444 |
| 2017/0215667 | A1 * | 8/2017 | Thorne | A47L 5/30 |
| 2018/0296046 | A1 | 10/2018 | Thorne et al. | |

FOREIGN PATENT DOCUMENTS

| | | |
|---|---|---|
| JP | S59-145354 | 9/1984 |
| JP | H1133275 | 2/1999 |
| JP | 2000354569 | 12/2000 |
| JP | 2014023930 | 2/2014 |
| JP | 2016510615 | 4/2016 |
| JP | 2018503473 | 2/2018 |
| JP | 2018521707 | 8/2018 |
| KR | 20100123585 | 11/2010 |
| WO | 2014140935 | 9/2014 |

OTHER PUBLICATIONS

Canadian Office Action dated Apr. 28, 2022, received in Canadian Patent Application No. 3,109,061, 5 pages.

Chinese Office Action with English translation dated Jan. 13, 2022, received in Chinese Patent Application No. 201980063575.9, 14 pages.

Australian Examination Report dated Feb. 15, 2022, received in Australian Patent Application No. 2019316629, 5 pages.

European Extended Search Report dated May 11, 2022, received in European Patent Application No. 19847661.6, 7 pages.

Japanese Office Action with English translation dated May 27, 2022, received in Japanese Patent Application No. 2021-507061, 11 pages.

Chinese Office Action with English translation dated Jun. 15, 2022, received in Chinese Patent Application No. 201980063575.9, 13 pages.

Chinese Office Action with English Summary dated Sep. 22, 2022, received in Chinese Patent Application No. 201980063575.9, 8 pages.

* cited by examiner

SYSTEM AND METHOD FOR REDUCING NOISE AND/OR VIBRATION IN A CLEANING APPARATUS WITH COMBING UNIT FOR REMOVING DEBRIS

CROSS-REFERENCE TO RELATED APPLICATIONS

The present application claims the benefit of U.S. Provisional Patent Application Ser. No. 62/717,309 filed on Aug. 10, 2018 and U.S. Provisional Patent Application Ser. No. 62/851,294 filed on May 22, 2019, both of which are fully incorporated herein by reference.

TECHNICAL FIELD

The present disclosure relates to a cleaning apparatus, such as a surface cleaning head for a vacuum cleaner, with a combing unit for removing debris from a cleaning roller, and more particularly for systems and method for reducing noise and/or vibration in such systems.

BACKGROUND INFORMATION

Vacuum cleaners generally include a suction conduit with an opening on the underside of a surface cleaning head for drawing air (and debris) into and through the surface cleaning head. One of the challenges with vacuum cleaner design is to control engagement of the suction conduit with a surface being cleaned to provide the desired amount of suction. If the suction conduit is spaced too far from a surface, the suction may be less because the air is flowing into the suction conduit through a greater surface area. If the suction conduit is directly engaged with the surface and thus sealed on all sides, air will stop flowing into the suction conduit and the suction motor may be damaged as a result.

Vacuum cleaners also generally use agitation to loosen debris and facilitate capturing the debris in the flow of air into the suction conduit. Agitators are often used in the suction conduit of a surface cleaning head proximate a dirty air inlet to cause the agitated debris to flow into the dirty air inlet. If the agitator in the suction conduit is unable to loosen the debris or if the debris is too small, the suction conduit may pass over the debris without removing the debris from the surface. In other cases, the surface cleaning head may push larger debris forward without ever allowing the debris to be captured in the flow into the suction conduit (sometimes referred to as snowplowing).

One example of an agitator is a cleaning roller such as a brush roll. A cleaning roller may be located within a suction conduit and/or may be located at a leading side of a suction conduit (e.g., a leading roller). One challenge with a leading roller in particular is the debris (e.g., hair) that becomes entangled around the roller. Projections may be used to engage the roller to facilitate removal of debris, but existing structures are often not effective and/or interfere with the operation of the surface cleaning head.

One solution to generally reduce and/or prevent debris from becoming entangled around the roller is to include a debriding rib. The debriding rib may include a plurality of teeth that contact and cut the debris on the roller as the roller rotates past the debriding rib. In some embodiments, a portion of the roller may also contact the plurality of teeth of the debriding rib. While the debriding rib is effective at generally reducing and/or preventing debris from becoming entangled around the roller, the contact between the roller and the plurality of teeth of the debriding rib may cause unwanted noise and/or vibration. As such, there exists a need for device that can generally reduce and/or prevent debris from becoming entangled around the roller while also minimizing and/or eliminating undesired noise and/or vibration.

DETAILED DESCRIPTION

Although specific embodiments of a surface cleaning head with a leading roller are shown, other embodiments of a cleaning apparatus with a combing unit are within the scope of the present disclosure. The cleaning apparatus may include any types of vacuum cleaner including, without limitation, an "all in the head" type vacuum, upright vacuum cleaners, canister vacuum cleaners, stick vacuum cleaners, robotic vacuum cleaners and central vacuum systems, and may be used in sweepers (e.g., low or no suction). The cleaning apparatus and/or surface cleaning head with a leading roller may also include removable agitators (e.g., brush rolls) in openable agitator chambers, such as the type described in greater detail in U.S. Pat. No. 9,456,723 and U.S. Patent Application Pub. No. 2016/0220082, which are commonly-owned and fully incorporated herein by reference. The leading roller may be similarly removable.

As used herein, a "surface cleaning head" refers to a device configured to contact a surface for cleaning the surface by use of suction air flow, agitation, or a combination thereof. A surface cleaning head may be pivotably or steeringly coupled by a swivel connection to a wand for controlling the surface cleaning head and may include motorized attachments as well as fixed surface cleaning heads. A surface cleaning head may also be operable without a wand or handle. In at least one example, a surface cleaning head may form part of a robot vacuum cleaner. As used herein, "seal" or "sealing" refers to preventing a substantial amount of air from passing through to the suction conduit but does not require an air tight seal. As used herein, "agitator" refers to any element, member or structure capable of agitating a surface to facilitate movement of debris into a suction air flow in a surface cleaning head. As used herein, "soft" and "softer" refer to the characteristics of a cleaning element being more compliant or pliable than another cleaning element. As used herein, the term "flow path" refers to the path taken by air as it flows into a suction conduit when drawn in by suction. As used herein, the terms "above" and "below" are used relative to an orientation of the surface cleaning head on a surface to be cleaned and the terms "front" and "back" are used relative to a direction that a user pushes the surface cleaning head on a surface being cleaned (i.e., back to front). As used herein, the term "leading" refers to a position in front of at least another component but does not necessarily mean in front of all other components. Unless otherwise stated, the term "substantially" is intended to mean +/−20% of the stated value.

Figure 1:
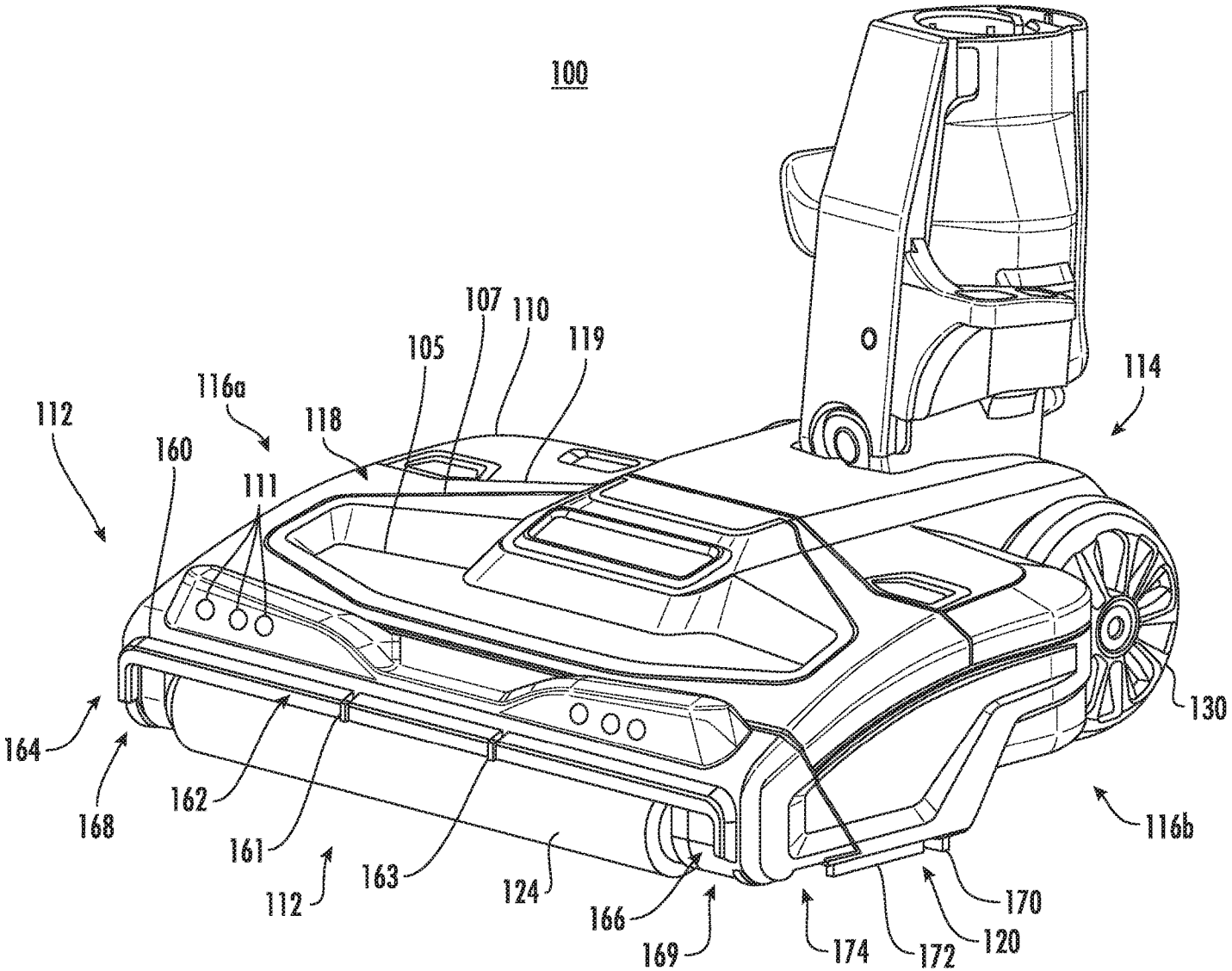
FIGS. 1-2 generally illustrate one example of a surface cleaning head consistent with the present disclosure.
Figure 2:
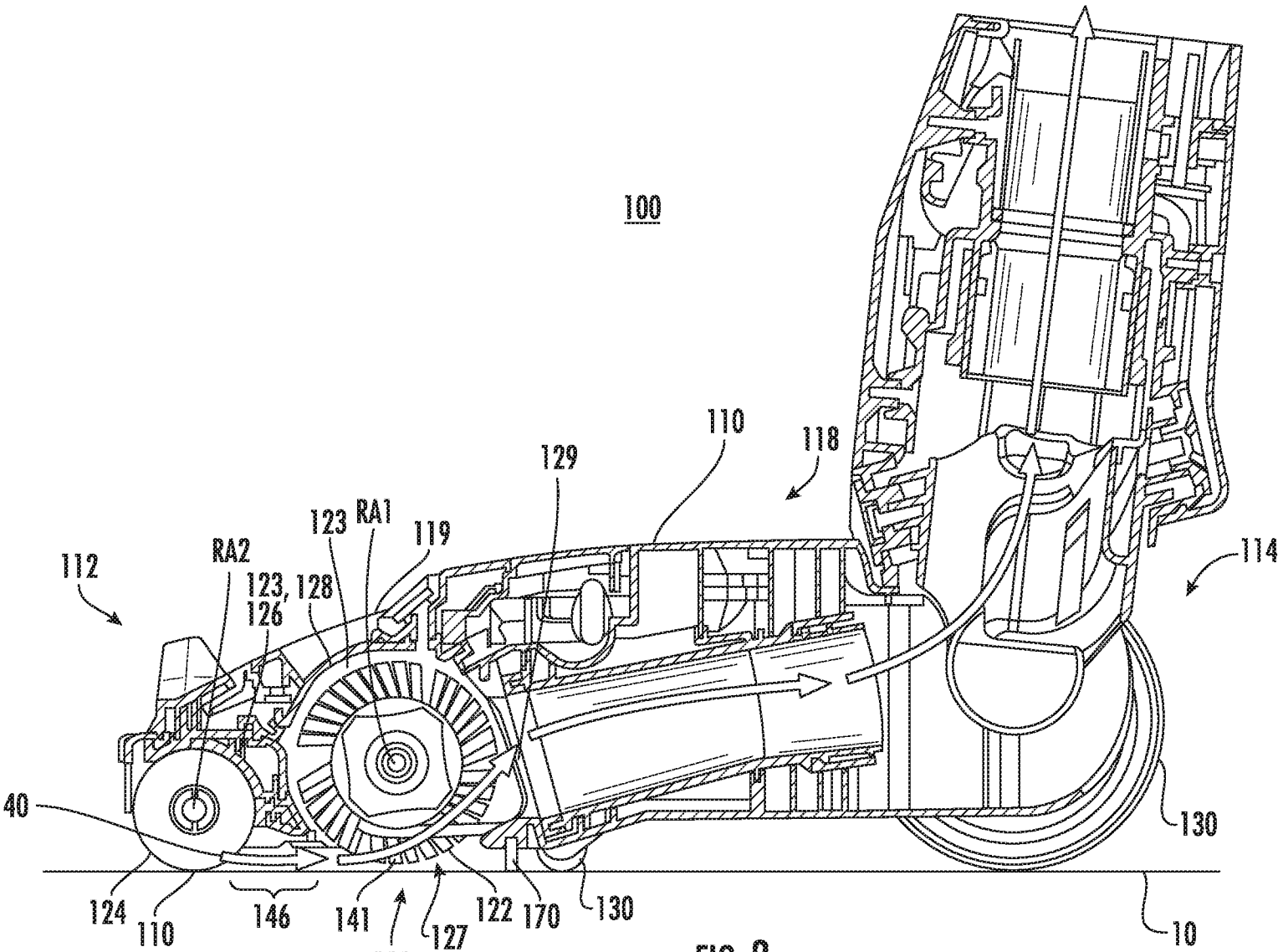

Referring to FIGS. 1-2, one embodiment of a surface cleaning head 100 is generally illustrated. It should be appreciated that the embodiment of the surface cleaning head 100 shown in FIGS. 1-2 is merely for exemplary purposes only, and that the present disclosure is not limited to this embodiment. The surface cleaning head 100 includes a housing 110 with a front side 112, and a back side 114, left and right sides 116*a*, 116*b*, an upper side 118, and a lower or under side 120. The housing 110 defines a suction conduit 128 and/or one or more agitator chambers 123 having an opening 127 on the underside 120 of the housing (shown in FIG. 2). The suction conduit 128 and/or agitator chamber(s) 123 is fluidly coupled to a dirty air inlet 129, which leads to a suction motor (not shown) either in the surface cleaning head 100 or another location in the vacuum. The suction conduit 128 and/or agitator chamber 123 is the interior space defined by interior walls in the housing 110, which receives and directs air drawn in by suction, and the opening 127 is where the suction conduit 128 and/or agitator chamber 123 meets the underside 120 of the housing 110.

In the illustrated embodiment, the surface cleaning head 100 includes dual rotating agitators 122, 124, for example, a brush roll 122 and a leading roller 124. The brush roll 122 and leading roller 124 may be configured to rotate about first and second rotating axes (RA1, RA2). The rotating brush roll 122 is at least partially disposed within the suction conduit 128 and/or agitator chamber(s) 123 (shown in FIG. 2). The leading roller 124 is positioned at least partially within an agitator chamber(s) 123 in front of and spaced from the brush roll 122 and at least substantially outside the suction conduit 128. In some embodiments, at least an inside upper portion (e.g., upper half) of the leading roller 124 is not exposed to the primary air flow path (e.g., arrow 40) into the opening 127 of the suction conduit 128 while at least an inside of the bottom portion of the leading roller 124 is exposed to the primary flow path into the opening 127 of the suction conduit 128.

Other variations are possible where different portions of the leading roller 124 may be exposed or not exposed to the flow path into the suction conduit 128. In other embodiments, for example, a flow path may allow air to flow over the upper portion of the leading roller 124. The leading roller 124 may rotate about the second rotation axis RA2 located within a leading roller/agitator chamber 123, 126. The leading roller chamber 126 may have a size and shape slightly larger than the cylindrical projection of the leading roller 124 when the leading roller 124 is rotating therein, for example, to form the flow path over the upper portion. While FIGS. 1-2 illustrate a surface cleaning head 100 having dual rotating agitators 122, 124, it should be appreciated that a surface cleaning head consistent with the present disclosure may include only a single rotating agitator or more than two agitators.

The surface cleaning head 100 may include one or more wheels 130 for supporting the housing 110 on the surface 10 to be cleaned. The brush roll 122 may be disposed in front of one or more wheels 130, 132 (see FIG. 1) for supporting the housing 110 on the surface 10 to be cleaned. For example, one or more larger wheels 130 may be disposed along the back side 114 and/or one or more smaller middle wheels 132 may be provided at a middle section on the underside 116 of the housing 110 and/or along the left and right sides 116*a*, 116*b*. Other wheel configurations may also be used. The wheels 130, 132 facilitate moving the surface cleaning head 100 along the surface 10 to be cleaned, and may also allow the user to easily tilt or pivot the surface cleaning head 100 (e.g., brush roll 122 and/or the leading roller 124) off the surface 10 to be cleaned. The rear wheel(s) 130 and the middle wheel(s) 132 may provide the primary contact with the surface 10 being cleaned and thus primarily support the surface cleaning head 100. When the surface cleaning head 100 is positioned on the surface 10 being cleaned, the leading roller 124 may also rest on the surface 10 being cleaned. In other embodiments, the leading roller 124 may be positioned such that the leading roller 124 sits just above the surface being cleaned.

The rotating brush roll 122 may have bristles, fabric, or other cleaning elements, or any combination thereof around the outside of the brush roll 122. Examples of brush rolls and other agitators are shown and described in greater detail in U.S. Pat. No. 9,456,723 and U.S. Patent Application Pub. No. 2016/0220082, which are fully incorporated herein by reference. By way of non-limiting examples, the brush roll may have a bristle diameter of 0.25 mm and/or an overall agitator diameter of 55 mm.

The leading roller 124 may include a relatively soft material (e.g., soft bristles, fabric, felt, nap or pile) arranged in a pattern (e.g., a spiral pattern) to facilitate capturing debris, as will be described in greater detail below. The leading roller 124 may be selected to be substantially softer than that of the brush roll 122. The softness, length, diameter, arrangement, and resiliency of the bristles and/or pile of the leading roller 124 may be selected to form a seal with a hard surface (e.g., but not limited to, a hard wood floor, tile floor, laminate floor, or the like), whereas the bristles of the brush roll 122 may selected to agitate carpet fibers or the like. For example, the leading roller 124 may be at least 25% softer than the brush roll 122, alternatively the leading roller 124 may be at least 30% softer than the brush roll 122, alternatively the leading roller 124 may be at least 35% softer than the brush roll 122, alternatively the leading roller 124 may be at least 40% softer than the brush roll 122, alternatively the leading roller 124 may be at least 50% softer than the brush roll 122, alternatively the leading roller 124 may be at least 60% softer than the brush roll 122. Softness may be determined, for example, based on the pliability of the bristles or pile being used.

The size and shape of the bristles and/or pile may be selected based on the intended application. For example, the leading roller 124 may include bristles and/or pile having a length of between 5 to 15 mm (e.g., 7 to 12 mm) and may have a diameter of 0.01 to 0.04 mm (e.g., 0.01-0.03 mm). According to one embodiment, the bristles and/or pile may have a length of 9 mm and a diameter of 0.02 mm. The bristles and/or pile may have any shape. For example, the bristles and/or pile may be linear, arcuate, and/or may have a compound shape. According to one embodiment, the bristles and/or pile may have a generally U and/or Y shape. The U and/or Y shaped bristles and/or pile may increase the number of points contacting the floor surface 10, thereby enhancing sweeping function of leading roller 124. The bristles and/or pile may be made on any material such as, but not limited to, Nylon 6 or Nylon 6/6.

Optionally, the bristles and/or pile of leading roller 124 may be heat treated, for example, using a post weave heat treatment. The heat treatment may increase the lifespan of the bristles and/or pile of the leading roller 124. For example, after weaving the fibers and cutting the velvet into rolls, the velvet may be rolled up and then run through a steam rich autoclave making the fibers/bristles more resilient fibers.

The leading roller 124 may have an outside diameter Dlr that is smaller than the outside diameter Dbr of the brush roll 122. For example, the diameter Dlr may be greater than zero and less than or equal to 0.8Dbr, greater than zero and less than or equal to 0.7Dbr, or greater than zero and less than or equal to 0.6Dbr. According to example embodiments, the diameter Dlr may be in the range of 0.3Dbr to 0.8Dbr, in the range of 0.4Dbr to 0.8Dbr, in the range of 0.3Dbr to 0.7Dbr, or in the range of 0.4Dbr to 0.7Dbr. As an illustrative example, the brush roll 122 may have an outside diameter of 48 mm and the leading roller 124 may have an outside diameter of 30 mm. While the leading roller 124 may have an outside diameter Dlr that is smaller than the outside diameter Dbr of the brush roll 122, the brush roll 122 may have bristles that are longer than the bristle and/or pile of the leading roller 122.

Positioning a leading roller 124 (having a diameter Dlr that is smaller than the diameter Dbr of the brush roll 122) in front of the brush roll 122 provides numerous benefits. For example, this arrangement decreases the height of the front side 112 of the surface cleaning head 100 (e.g., the housing 110) from the surface 10 to be cleaned. The decreased height of the front of the surface cleaning head 100 provides a lower profile that allows the surface cleaning head 100 to fit under objects (e.g., furniture and/or cabinets). Moreover, the lower height allows for the addition of one or more light sources 111 (e.g., but not limited to, LEDs), while still allowing the surface cleaning head 100 to fit under objects.

Additionally, the smaller diameter Dlr of the leading roller 124 allows the rotating axis of the leading roller 124 to be placed closer to the front side 112 of the surface cleaning head 100. When rotating, the leading roller 124 forms a generally cylindrical projection having a radius that is based on the overall diameter of the leading roller 124. As the diameter of the leading roller 124 decreases, the bottom contact surface 140 (FIG. 2) of the leading roller 124 moves forward towards the front side 112 of the surface cleaning head 100. In addition, when the surface cleaning head 100 contacts a vertical surface 12 (e.g., but not limited to, a wall, trim, and/or cabinet), the bottom contact surface 140 of the leading roller 124 is also closer to the vertical surface 12, thereby enhancing the front edge cleaning of the surface cleaning head 100 compared to a larger diameter leading roller. Moreover, the smaller diameter Dlr of the leading roller 124 also reduces the load/drag on the motor driving the leading roller 124, thereby enhancing the lifespan of the motor and/or allowing a smaller motor to be used to rotate both the brush roll 122 and leading roller 124.

The rotating brush roll 122 may be coupled to an electrical motor (either AC or DC) to cause the rotating brush roll 122 to rotate about the first rotating axis. The rotating brush roll may be coupled to the electrical motor by way of a gears and/or drive belts. The leading roller 124 may be driven from the same drive mechanism used to drive the rotating brush roll 122 or a separate drive mechanism. An example of the drive mechanism is described in U.S. patent application Ser. No. 15/331,045, filed Oct. 21, 2016, which is incorporated herein by reference. Other drive mechanisms are possible and within the scope of the present disclosure.

In at least one embodiment, the brush roll 122 and the leading roller 124 rotate in the same direction directing debris toward the suction conduit 128, for example, counter clockwise as shown in FIG. 2. This arrangement may reduce the number of parts (e.g., no clutch or additional gear train may be necessary), thereby making the surface cleaning head 100 lighter, reducing drivetrain loss (thereby allowing for smaller/less expensive motors), and less expensive to manufacture. Optionally, the brush roll 122 and the leading roller 124 may rotate at same speed, thereby reducing the number of parts (e.g., no additional gear train necessary) and reducing drivetrain loss (thus, smaller/less expensive motor) and making the surface cleaning head 100 lighter and less expensive to manufacture.

As shown in FIG. 2, the leading roller 124 may be positioned within the housing 110 such that the bottom contact surface 140 is disposed closer to the surface 10 to be cleaned compared to the bottom contact surface 144 of the brush roll 122. This arrangement allows the leading roller 124 to contact a surface 10 (e.g., a hard surface) without the brush roll 122 contacting the hard surface 10. As may be appreciated, the leading roller 124 is intended to pick up debris from a hard surface 10 while the brush roll 122 is intended to primarily contact a carpet surface. This arrangement is therefore beneficial since it allows the leading roller 124 to form a seal between the front 112 of the surface cleaning head 100 with the hard surface 10, thereby enhancing airflow and suction with the hard surface 10. Additionally, this arrangement reduces the drag/torque on the drive motor(s) since the brush roll 122 (in some embodiments) does not have to contact the hard surface 10. The reduced drag/torque may allow for a smaller, less expensive motor and/or may increase the lifespan of the motor.

One or both of the leading roller 124 and the brush roll 122 may be removable. The leading roller 124 may be removably coupled to the housing 110 of the surface cleaning head 100. For example, a portion of the housing 110 (such as, but not limited to, a portion of the left and/or right side 116*a*, 116*b*) may be removably/hingedly coupled thereto. To remove the leading roller 124, the removable portion may be unsecured/uncoupled from the rest of the housing 110, thereby allowing the leading roller 124 to disengage from a drive wheel and allowing the leading roller 124 to be removed from the leading roller chamber 126. Other ways of removably coupling the leading roller 124 within the housing 110 are also possible and within the scope of the present disclosure. In some embodiments, the housing 110 of the surface cleaning head 100 may include a removable and/or hinged panel that allows one or more agitators 122, 124 to be removed. A shown in FIG. 1, for example, the surface cleaning head 100 includes a panel 119. Optionally, the panel 119 may be removably and/or hingedly coupled to the housing 110 to provide access to and/or define a portion of an agitator chamber 123. The panel 119 may be configured to move between a closed position (in which the panel 119 is secured to the housing 110, e.g., to define a portion of the agitator chamber 123) and an open position (in which the panel 119 allows for access to the agitator chamber 123). To remove the brush roll 122, the panel 119 may be disengaged from the housing 110 (e.g., removed and/or hinged) to allow the user to have access to an agitator roll chamber 123. Examples of removable panels or covers and removable brush rolls are described in greater detail in U.S. Pat. No. 9,456,723 and U.S. patent application Pub. No. 2016/0220082, which are fully incorporated herein by reference. The ability to remove the brush roll 122 and/or the leading roller 124 from the surface cleaning head 100 allows the brush roll 122 and/or the leading roller 124 to be cleaned more easily and may allow the user to change the size of the brush roll 122 and/or the leading roller 124, change type of bristles on the brush roll 122 and/or the leading roller 124, and/or remove the brush roll 122 and/or the leading roller 124 entirely depending on the intended application.

Alternatively (or in additional), the leading roller 124 may be removable in the same way. Another example of a removable leading roller is described in U.S. patent application Ser. No. 15/331,045, filed Oct. 21, 2016, which is incorporated herein by reference. Alternatively, the panel 119 may not be removable relative to the housing 110. As such, in any of the examples described herein, the panel 119 may be either non-removable relative to the housing 110 or removably and/or hingedly coupled to the housing 110 unless specifically described.

Figure 3:
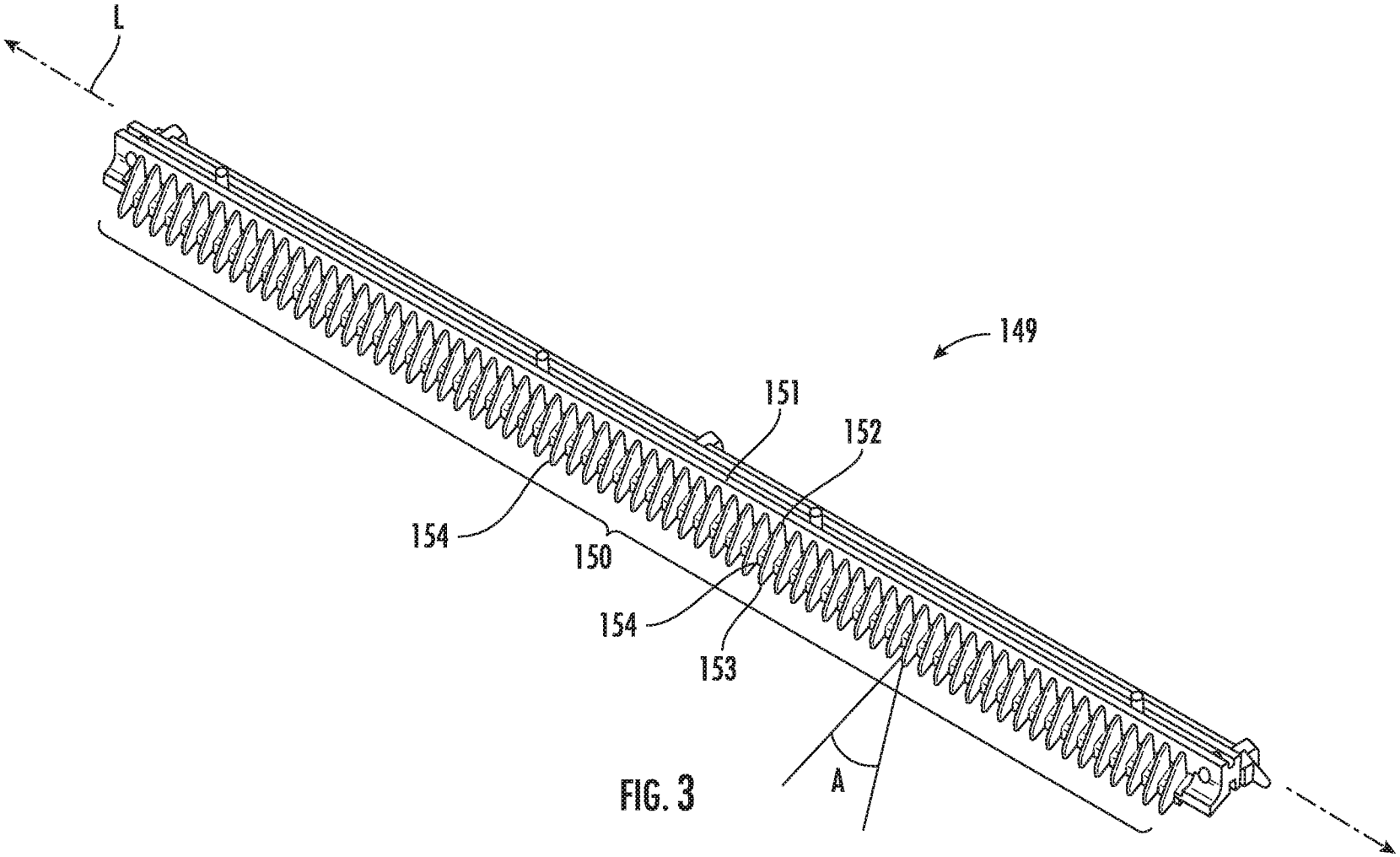
FIG. 3 generally illustrates one example of a combing unit/debrider consistent with the present disclosure.
Figure 4:
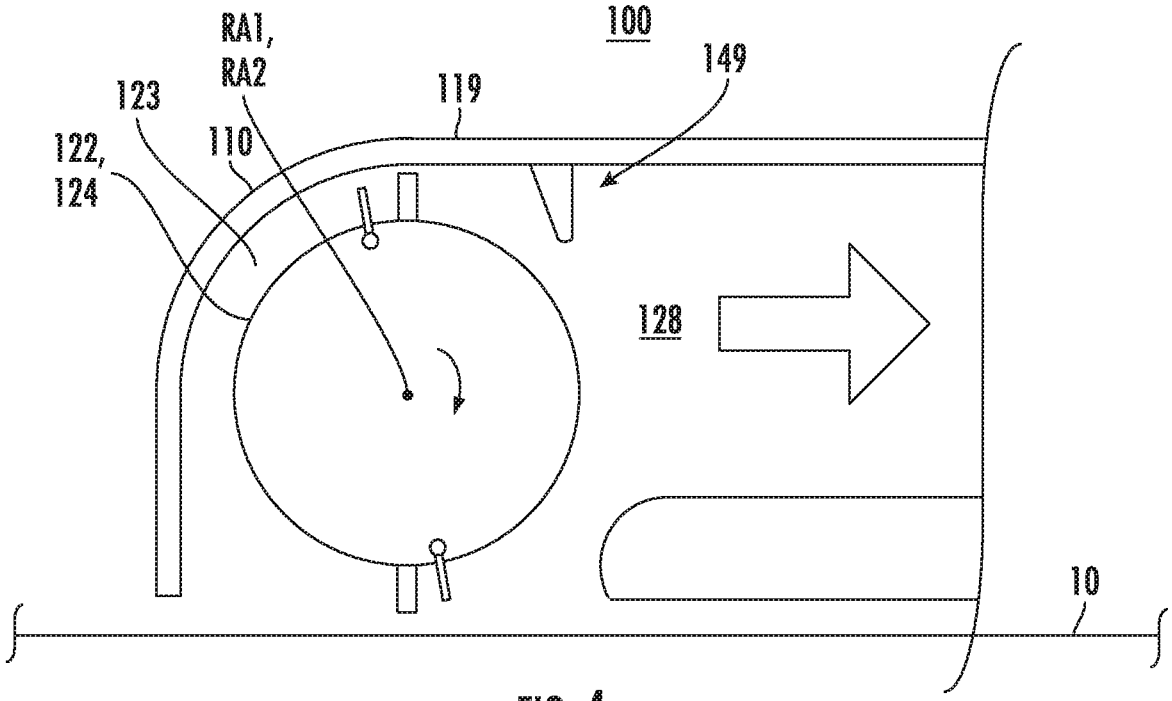
FIG. 4 generally illustrates one example of a surface cleaning head including a combing unit/debrider consistent with the present disclosure.

The surface cleaning head 100 may also include one or more combing units/debriders each having a series of combing protrusions (also referred to as debriding protrusions) configured to contact one or more of the agitators (e.g., brush roll 122 and/or the leading roller 124). One example of the combing unit/debrider 149 is shown in FIG. 3 and another example of the combing unit/debrider 149 along with a surface cleaning head 100 is shown in FIG. 4. The combing protrusions 150 may be configured to remove debris (such as, but not limited to, hair, string, and the like) that may be wrapped around and/or entrapped/entrained in/on the brush roll 122 and/or the leading roller 124 as the surface cleaning head 100 is being used (e.g., without the user having to manually remove the debris from the brush roll 122 and/or the leading roller 124). According to one embodiment, the combing protrusions 150 may contact only the brush roll 122 and/or only the leading roller 124.

The combing protrusions 150 may include a plurality of spaced teeth/ribs 152 with angled edges 153 extending into contact with a surface of the brush roll 122 and/or the leading roller 124. The spaced ribs 152 extend from a back support 151 with base portions 154 located therebetween to reinforce the spaced ribs 152. Although the illustrated embodiment shows the combing unit 150 with teeth 152 extending from a single back support 151, the combing unit 149 may also include multiple back supports 151 with one or more include teeth 152. The angled edges 153 of the spaced ribs 152 may be arranged at an angle A (see FIG. 3) that is in the range of 15-20 degrees, for example, 20-25 degrees, such as 23.5 degrees. This example structure of the combing protrusions 150 may allow for increased strength and reduced frictional loses since less points may contact the brush roll 122 and/or the leading roller 124. Other shapes and configurations for the combing protrusions 150 are also within the scope of the present disclosure.

The combing teeth 152 have angled leading edges 153 that are not aligned with a rotation center of the agitator(s) 122, 124. The angled leading edges 153 are the edges that an incoming portion of the rotating agitator(s) 122, 124 hits first and are directed toward or into a direction of rotation of the agitator(s) 122, 124. More specifically, the leading edge 153 of a combing tooth 152 forms an acute angle A relative to a line extending from an intersection point where the leading edge 153 intersects with an outer surface of the agitator(s) 122, 124 to the rotation center. In some embodiments, the angle is in a range of 5° to 50° and more specifically in a range of 20° to 30° and even more specifically about 24° to 25°.

In some embodiments, the combing teeth 152 are positioned as close as possible to the bottom contact point of the agitator(s) 122, 124 but high enough to prevent being caught on a surface being cleaned (e.g., a carpet). The combing teeth 152, for example, may be positioned just above the lowest structure on the housing 110 of the cleaning apparatus 100. Positioning the combing teeth 152 closer to the bottom contact point of the agitator(s) 122, 124 allows debris to be intercepted and removed as soon as possible, thereby improving debris removal.

Again, it should be appreciated that the combing unit 149 may have other orientations and positions relative to the agitator(s) 122, 124 (e.g., above the rotation center). In a robotic vacuum cleaner, for example, the combing unit 149 may be positioned higher to prevent the combing teeth 152 from interfering with the debris being deposited into a dust bin.

The combing teeth 152 may extend into the agitator(s) 122, 124 to a depth in a range of 0% to 50% of the cleaning roller radius for a soft roller and 0% to 30% of the cleaning roller radius for a tufted brush roll. In one embodiment, the cleaning roller 124 is a soft roller (e.g., nylon bristles with a diameter less than or equal to 0.15 mm and a length greater than 3 mm) and the combing teeth 152 extend into the soft cleaning roller 124 in a range of 15% to 35%.

In the illustrated embodiments, the combing teeth 152 have a triangular-shaped "tooth" profile with a wider base or root 154 having a root width $W_r$ and a tip 156 having a diameter $D_r$. In general, the base or root 154 may be wide enough to prevent the tooth 152 from bending upward when contacted by the rotating cleaning roller 124 and the tip 156 may be sharp enough to catch the debris. In some embodiments, the tip 156 may be rounded with a diameter in the range of less than 3 mm and more specifically in the range of 1 to 2 mm and even more specifically about 1.6 mm. The root width $W_r$ may be in a range of 5 to 6 mm.

In another embodiment, combing teeth 152 may have a curved profile with curved leading edges 153 forming a concave curve. In this embodiment, a line extending from the curved leading edge 153 at the tip 156 forms an angle with a line extending from the intersection point to the rotation center. The combing teeth 152 with curved edges may be positioned and spaced similar to the teeth 152 with straight leading edges 153 as described and shown herein.

In some embodiments, the combing unit 149 includes combing teeth 152 spaced 4 to 16 teeth per inch and more specifically 7 to 9 teeth per inch. The combing teeth 152 may be made of plastic or metal and may have a thickness that provides a desired rigidity to prevent bending when engaged with the rotating cleaning roller 124. In some embodiments, the combing teeth 152 may have a thickness in a range of 0.5 to 2 mm depending upon the material. In one example, the combing teeth 152 are made of plastic and have a thickness of 0.8 mm, a spacing S of about 2.4 mm, and a center-to-center spacing $S_c$ of about 3.3 mm.

Although the combing unit 149 is shown with combing teeth 152 having an equal spacing, a combing unit 149 may also include teeth 152 with different spacings including, for example, groups of equally spaced teeth. The combing unit 149 may include a section at the center of the cleaning roller 124 with no teeth and groups of combing teeth 152 proximate ends of the cleaning roller 124 where the hair and similar debris migrates during rotation. Although the combing unit 149 is shown with teeth 152 having the same shape or tooth profile and dimensions, the combing unit 149 may include teeth of different shapes, profiles dimensions and configurations at different locations along the combing unit 149.

The combing unit 149 may extend along a substantial portion of a longitudinal length of the agitator(s) 122, 124 (i.e., more than half of the longitudinal length of the agitator(s) 122, 124, greater than 75% of the longitudinal length of the agitator(s) 122, 124, greater than 90% of the longitudinal length of the agitator(s) 122, 124) such that the combing teeth 152 remove debris from a substantial portion of the cleaning surface of the agitator(s) 122, 124. The combing unit 149 works particularly well with cleaning rollers that are designed to move hair and other similar debris away from a center of the agitator(s) 122, 124. In another embodiment, the combing teeth 152 may engage the cleaning surface of the agitator(s) 122, 124 along, for example, less than 50% of the longitudinal length of the agitator(s) 122, 124, for example, less than 30% of the longitudinal length of the agitator(s) 122, 124 and/or less than 20% of the longitudinal length of the agitator(s) 122, 124. In this example, the combing unit 149 works particularly well with cleaning rollers that are designed to move hair and other similar debris towards a collection location of the agitator(s) 122, 124 (e.g., a collection area such as, but not limited to, a center of the agitator(s) 122, 124).

The combing unit 149 may be mounted to any portion of the surface cleaning head 100 (such as, but not limited to, the body 110 and/or the panel 119) as generally illustrated in FIG. 4. For example, the combing unit 149 may be mounted at least partially within a chamber (e.g., an agitator chamber 123) containing either the brush roll 122 and/or the leading roller 124. While the combing unit 149 is generally effective at reducing and/or preventing buildup of debris on the agitator(s) 122, 124, contact between the combing unit 149 and the agitator(s) 122, 124 due to rotation of the agitator(s) 122, 124 can create unwanted noise and/or vibration. The noise and/or vibration may cause the surface cleaning head 100 to exceed regulatory limits and/or result in an undesired user experience.

According to one example, the present disclosure features one or more combing isolators disposed at least partially between the combing unit 149 and a portion of the surface cleaning head 100 (e.g., the body 110 and/or the panel 119). The combing isolator may be at least partially formed from a material configured to absorb vibration caused by contact between the combing unit 149 and the agitator(s) 122, 124 due to rotation of the agitator(s) 122, 124. For example, the combing isolator may convert vibrational energy from the combing unit 149 into heat, thereby reducing the transfer of vibrational energy to the surface cleaning head 100 (e.g., the body 110 and/or the panel 119). Testing has shown a surface cleaning head without the combing isolator may generate a noise level of 79.9 dBa, while a surface cleaning head 100 with a combing isolator consistent with the present disclosure may generate a noise level of only 76.6 dBa. Of course, this is merely one example, and the present disclosure is not limited to this noise reduction. The combing isolators may therefore significantly reduce the noise and/or vibration due to the interaction of either the brush roll 122 and/or the leading roller 124 against the combing unit 149, which in turn improves the user experience and/or allows the surface cleaning head 100 to meet any necessary noise and/or vibration requirements/guidelines.

In at least one example, the combing isolator may be formed, at least in part, from an elastomeric material. Non-limiting examples of elastomeric materials include polyvinyl chloride (PVC), rubber (both natural and synthetic), silicone, and the like. The elastomeric materials may have a shore hardness of 30 to 90. For example, the combing isolator may be formed from a PVC having a shore hardness of 30 to 90 such as, but not limited to, a shore hardness of 50, 70, and/or 85, including all ranges therein. Testing has shown that shore 70 provides a greater SPL reduction compared to shore 80 and 85.

The size and shape of the combing isolator may be selected based on the intended application. For example, the size and shape of the combing isolator may be determined, at least in part, on the impact force and/or frequency between the agitator 122, 124 and the spaced teeth/ribs 152 of the combing unit 149, and the desired amount of attenuation of vibration and/or sound. According to one example, the combing isolator may be located entire within the body 110 and/or the panel 119 of the surface cleaning head 100.

Alternatively, the combing isolator may be located entirely outside (i.e., external to) of the body 110 and/or the panel 119 of the surface cleaning head 100. In yet another example, the combing isolator may be located partially within and partially outside of the body 110 and/or the panel 119 of the surface cleaning head 100.

In some examples, the combing unit 149 may be secured to the combing isolator in any manner known to those skilled in the art. The combing isolator may be disposed at least partially between the combing unit 149 and the body 110 and/or the panel 119 of the surface cleaning head 100. For example, a single combing isolator may extend substantially continuously with (e.g., coextensive with) the combing unit 149 (e.g., the back support 151), though it should be appreciated that one or more combing isolators may be adjacent to each other along the longitudinal length L of the combining unit 149 (e.g., the back support 151). For example, two or more combing isolators may be run parallel to each other along a common portion of the combing unit 149 in a side-by-side arrangement and/or two or more combing isolators may run sequentially to each other when moving along the longitudinal axis L of the combing unit 149. Alternatively (or in additional), two or more combing isolators may be stacked upon each other in a direction substantially transverse the longitudinal axis L. As used herein, the phrase "substantially coextensive with" is intended to mean that the combing isolator is in contact with at least 80% of the surface of the combining unit 149 (e.g., the back support 151) that is immediately adjacent to (e.g., between) the combining unit 149 and the mounting surface with the housing 110. For example, the combing isolator may contact at least 90% of the surface of the combining unit 149 and/or contact at least 95% of the surface of the combining unit 149. It should also be appreciated that the combing isolator(s) do not have to be coextensive with the combing unit 149 (e.g., the back support 151). In such an embodiment, the combing isolator(s) may be disposed between the combing unit 149 and the housing 110 along only a portion of the combing unit 149.

The combing isolator may be disposed along one or more discrete and separate portions between the combing unit 149 and the body 110 and/or the panel 119 of the surface cleaning head 100. For example, a plurality of discrete and separate combing isolators may be spaced apart from adjacent isolators. A combing isolator may be disposed between the back support 151 of the combing unit 149 and the housing 110 and/or the panel 119 of the surface cleaning head 100. For example, the combing isolator may be disposed between the back support 151 of the combing unit 149 and an interior surface of the agitation chamber 123 containing either the brush roll 122 and/or the leading roller 124. It should be appreciated, however, that a combing isolator may be located between the combing unit 149 and an exterior surface, and/or between the combing isolator and any surface between the interior and exterior surfaces. The combing isolator may therefore be configured to contact at least a portion of the combing unit 149 and the body 110 and/or the panel 119 of the surface cleaning head 100.

Figure 5:
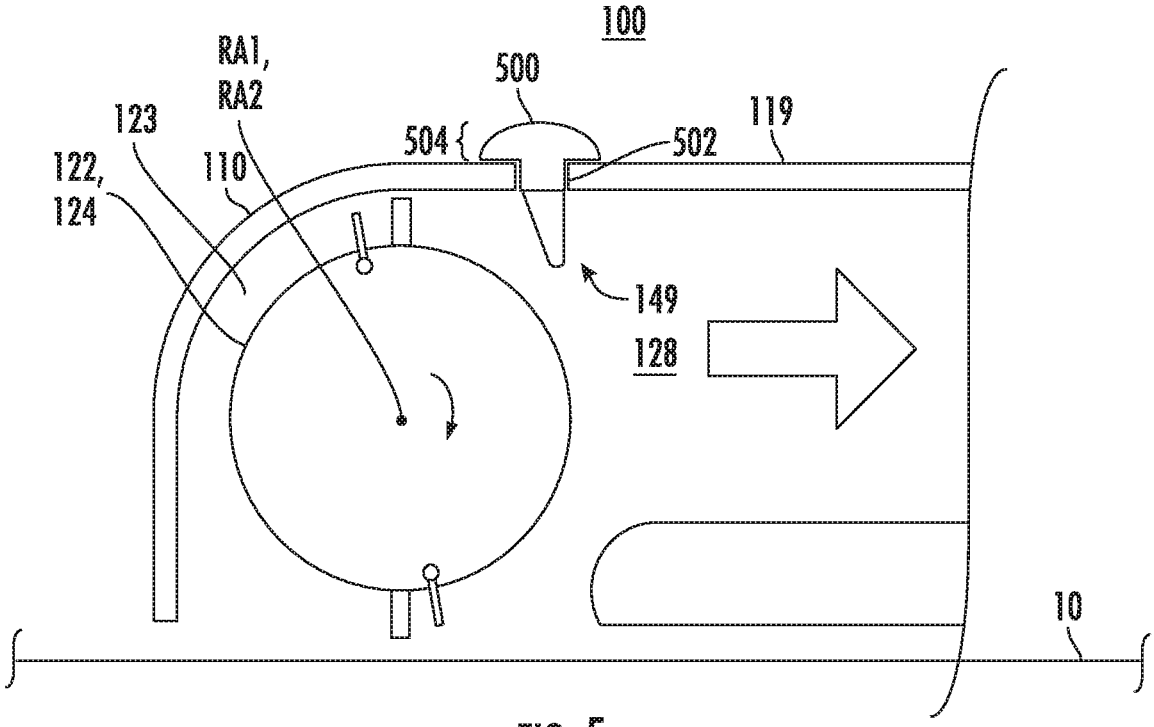
FIG.5 generally illustrates one example of a combing isolator secured to a body and/or a panel of the surface cleaning head consistent with the present disclosure.

One example illustrating how to secure a combing isolator to the body 110 and/or the panel 119 of the surface cleaning head 100 is generally illustrated in FIG. 5. The combing isolator 500 may be secured to the body 110 and/or the panel 119 of the surface cleaning head 100 without the aid of any additional component. Put another way, the combing isolator 500 itself may form the connection with the body 110 and/or the panel 119 of the surface cleaning head 100. In at least one example, the combing isolator 500 may be directly coupled to the body 110 and/or the panel 119 of the surface cleaning head 100. For example, the combing isolator 500 may be configured to exert an outward radial force against a portion of a hole 502 in the body 110 and/or the panel 119 of the surface cleaning head 100 to secure the combing isolator 500 thereto, e.g., as generally illustrated in FIG. 5. Alternatively (or in addition), the combing isolator 500 may be shaped such that the combing isolator 500 does not fit through the hole 502. For example, the combing isolator 500 may include a portion 504 having at least one cross-sectional dimension (e.g., but not limited to, a diameter or width) that is larger than at least one cross-sectional dimension (e.g., but not limited to, a diameter or width) of the hole 502. In the illustrated example, the portion 504 may form an enlarged head or the like.

Figure 6:
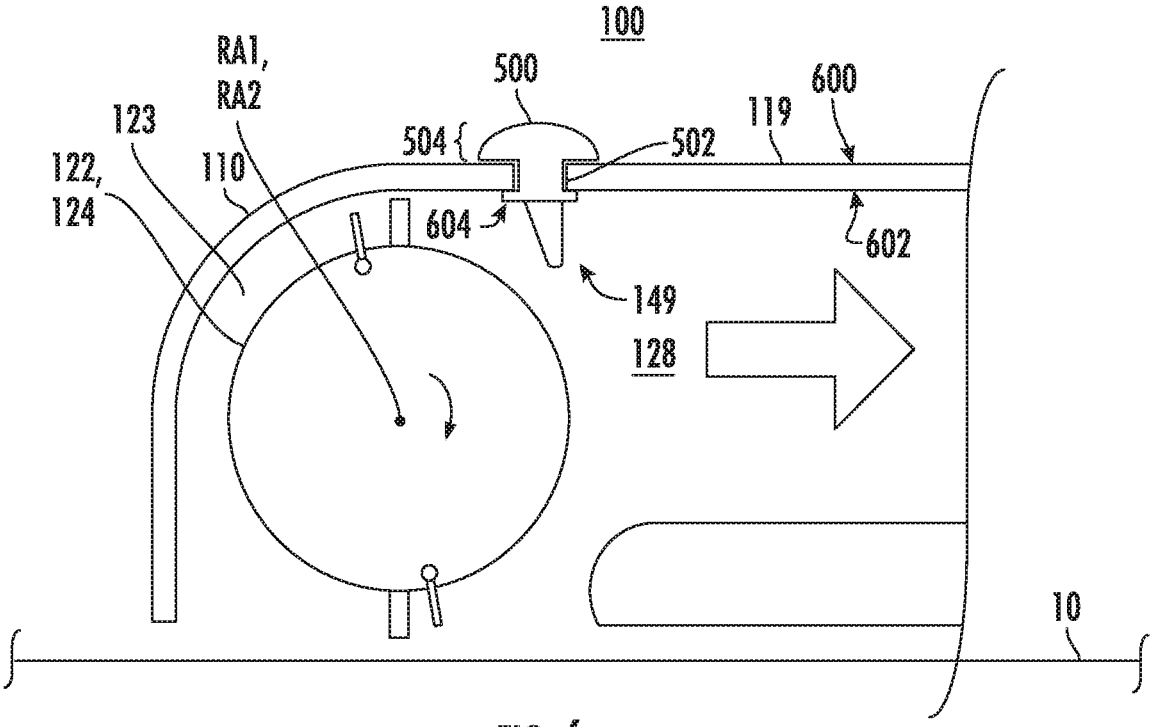
FIG. 6 generally illustrates one example of a combing isolator configured to exert an inward compressive force consistent with the present disclosure.

Alternatively (or in addition), the combing isolator 500 may be configured to exert an inward compressive force against a portion of a top and bottom surface 600, 602 proximate to a hole in the body 110 and/or the panel 119 of the surface cleaning head 100 to secure the combing isolator 500 thereto, e.g., as generally illustrated in FIG. 6. For example, the combing isolator 500 may include an upper portion 504 and a lower portion 604 each having at least one cross-sectional dimension (e.g., but not limited to, a diameter or width) that is larger than at least one cross-sectional dimension (e.g., but not limited to, a diameter or width) of the hole 502. It should be appreciated that the combing isolator 500 may not exert an inward and/or radial force, and instead the upper and lower portions 504, 604 of combing isolator 500 may be shaped such that the combing isolator 500 does not fit through the hole 502. In any case, a benefit of directly securing the combing isolator 500 to the body 110 and/or the panel 119 as generally illustrated in FIGS. 5 and 6 is that the manufacturing process may be greatly simplified, while also reducing the number of parts and therefore lowering the cost of manufacture. It should be appreciated that the combing isolator 500 may be secured to the combing unit 149 in any manner known to those skilled in the art such as, but not limited to, adhesives, welding, molding, and/or fasteners.

Figure 7:
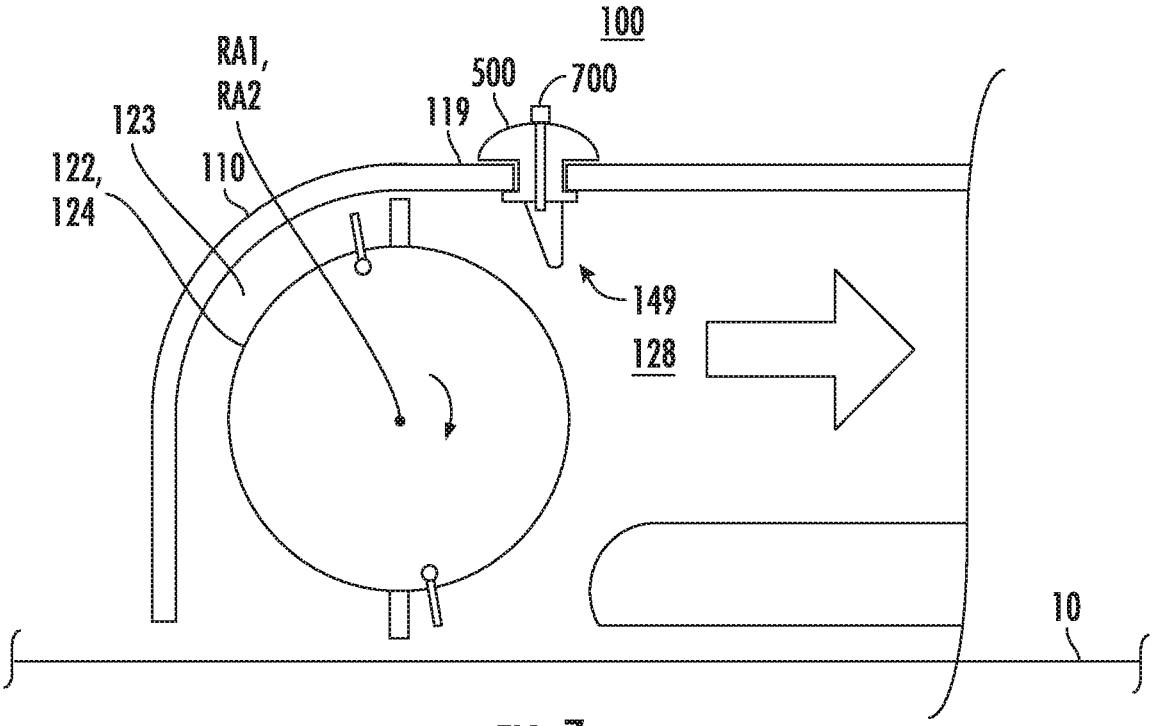
FIG. 7 generally illustrates another example illustrating a connection between the combing isolator and the body and/or the panel of the surface cleaning head consistent with the present disclosure.

With reference to FIG. 7, another example illustrating a connection between the combing isolator 500 and the body 110 and/or the panel 119 of the surface cleaning head 100 is generally illustrated. In particular, the combing isolator 500 may include and/or form part of a rivet such, as but not limited to, a blind rivet, a push-pin rivet, an expanding rivet, or the like. The rivet may include, for example, a mandrel 700 or the like configured to generate a radial and/or compressive force. Optionally, the mandrel 700 may also secure the combing unit 149 to the combing isolator 500. A benefit of securing the combing isolator 500 to the body 110 and/or the panel 119 using a rivet is that it may allow for more precise location of the combing unit 149 and/or may increase the longevity of the connection to the body 110 and/or the panel 119.

Figure 8:
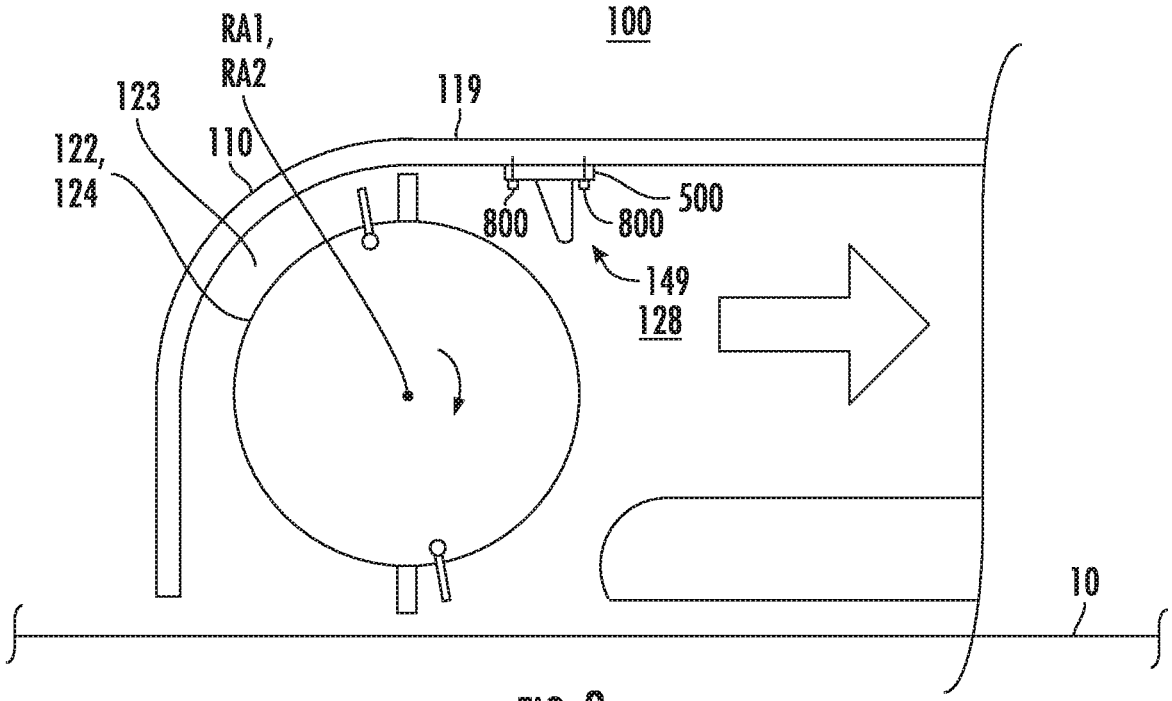
FIG. 8 generally illustrates one example of a combing isolator secured to the body and/or the panel of the surface cleaning head using one or more fasteners consistent with the present disclosure.
Figure 9:
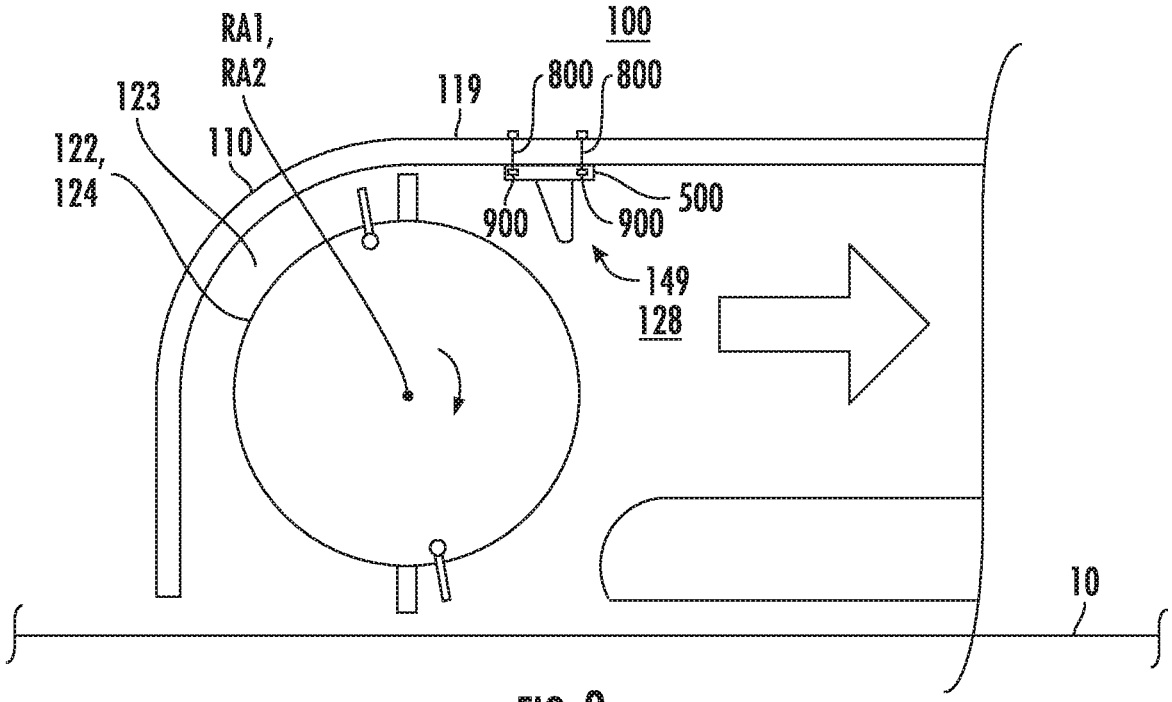
FIG. 9 generally illustrates one example of a fastener securing the combing isolator to the body and/or the panel consistent with the present disclosure.

Turning now to FIG. 8, the combing isolator 500 may be secured to the body 110 and/or the panel 119 of the surface cleaning head 100 using one or more fasteners 800. The fasteners 800 may include any known fasteners such as, but not limited to, screws, bolts, rivets, or the like. In the illustrated example, the fasteners 800 extend at least partially through a portion of the combing isolator 500 and are secured to (e.g., secured into and/or onto) the body 110 and/or the panel 119 of the surface cleaning head 100. The fasteners 800 may therefore directly secure the combing isolator 500 to the body 110 and/or the panel 119. In at least one example, the combing isolator 500 may be over-molded around a portion 900 (e.g., a head or the like) of one or more of the fasteners 800 as generally illustrated in FIG. 9.

Figure 10A:
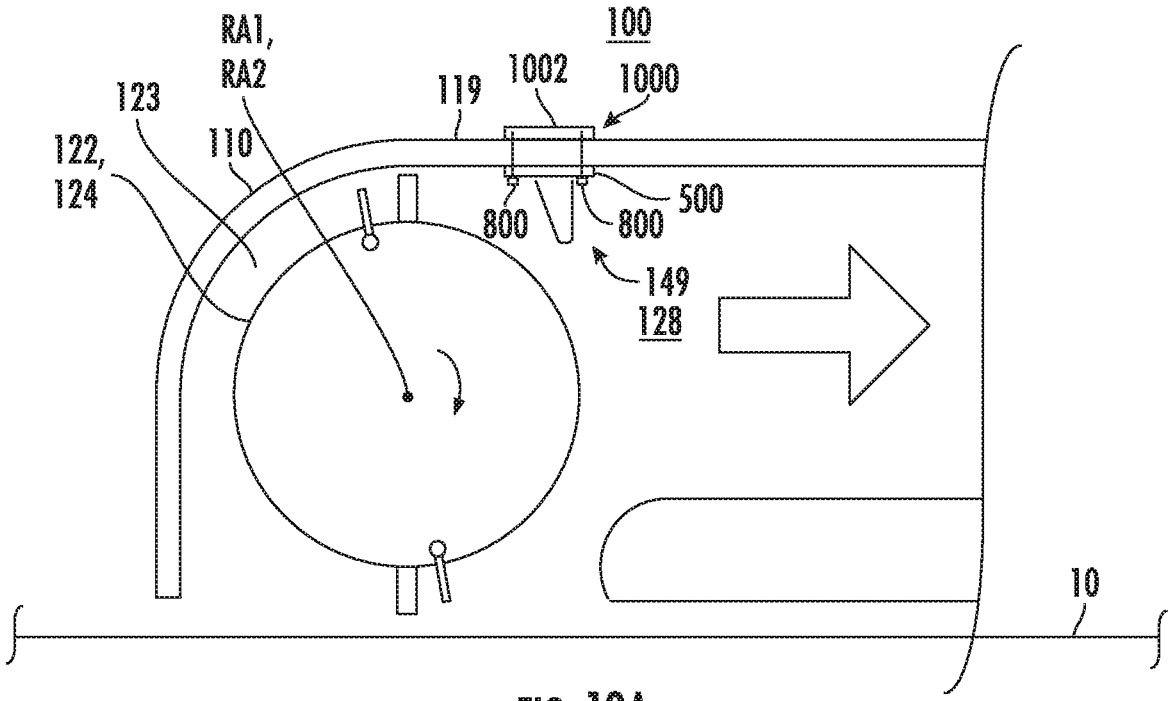
FIGS. 10A and 10B generally illustrate a combing isolator secured to the body and/or the panel by way of a clamp consistent with the present disclosure.
Figure 10B:
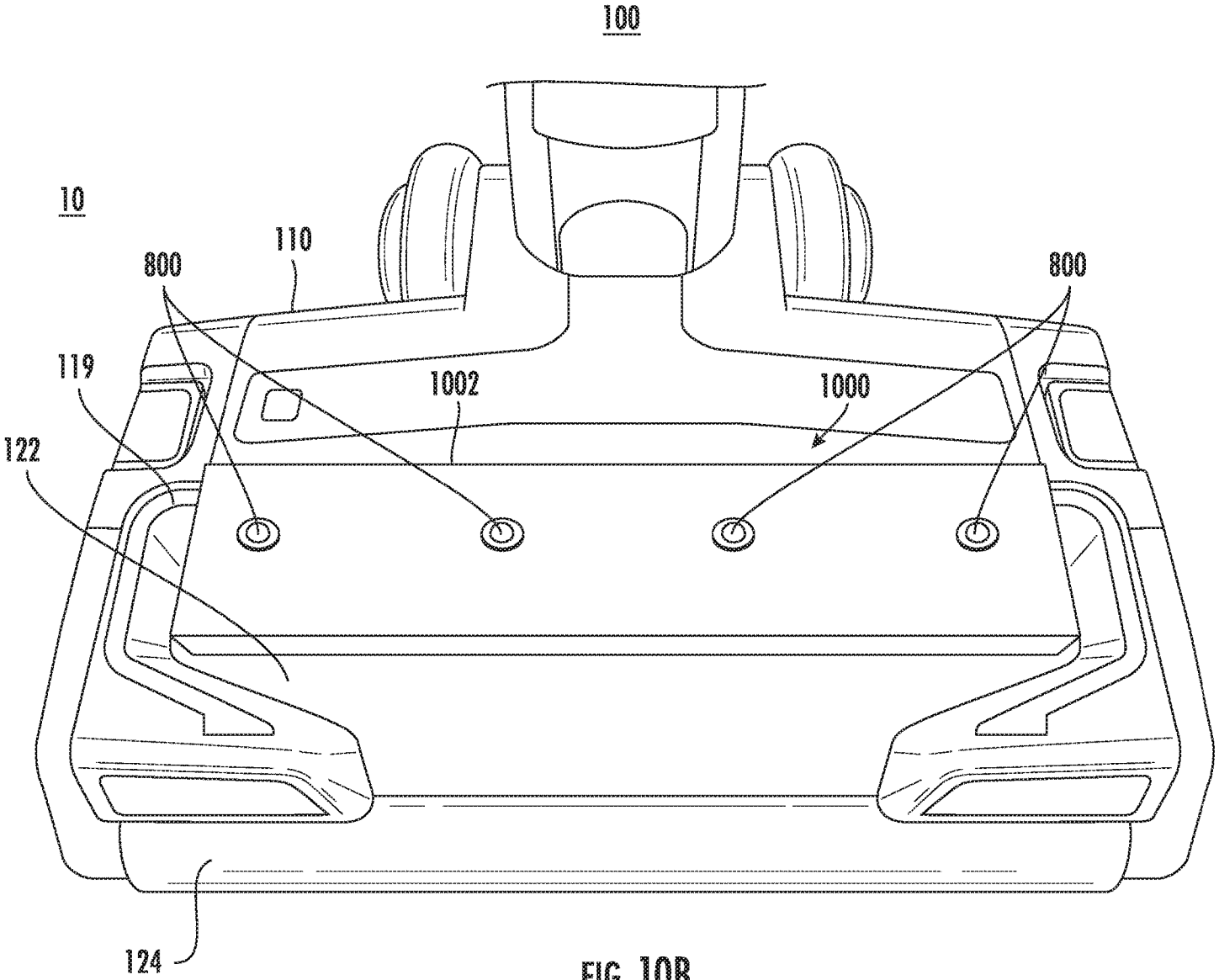
Figure 11A:
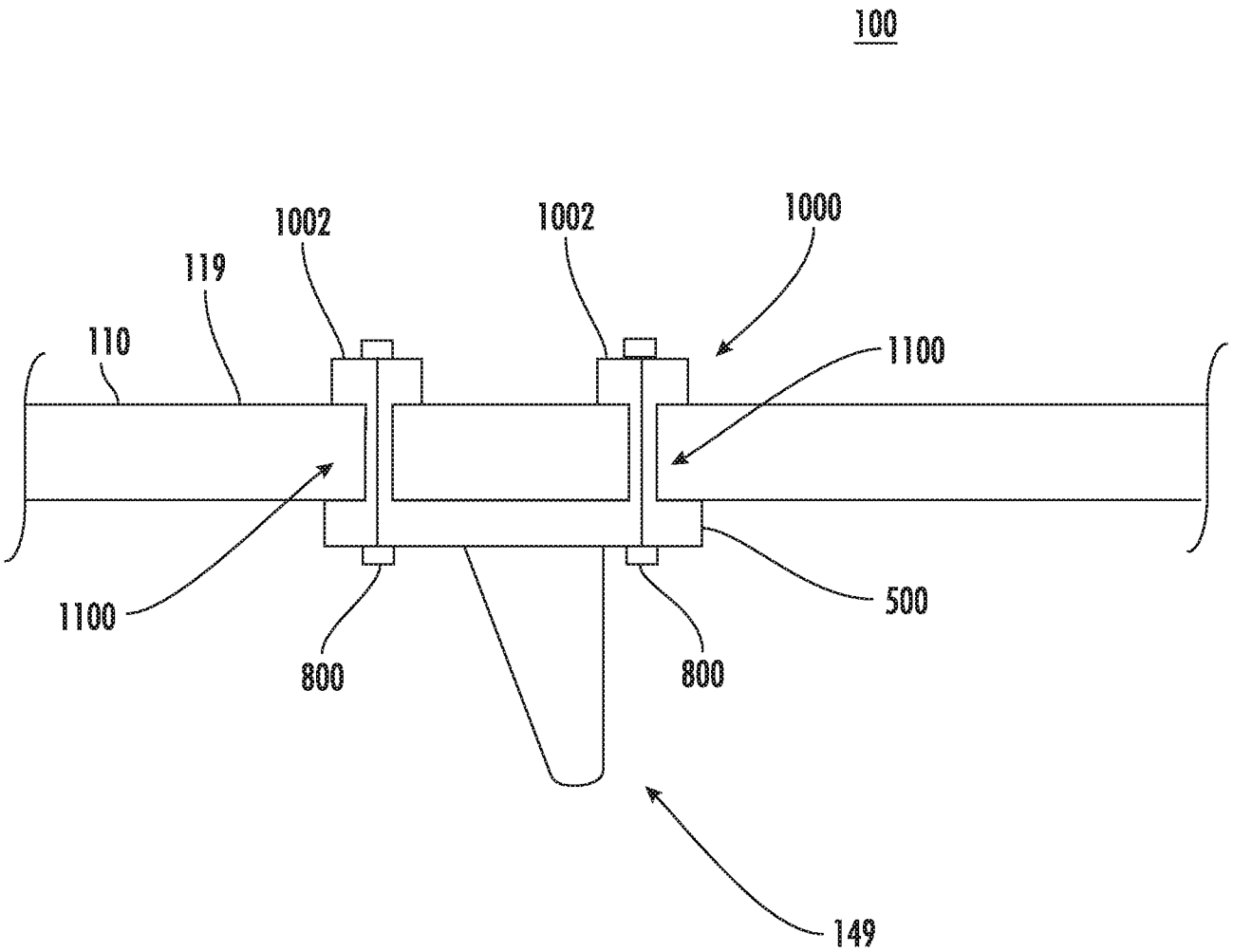
FIGS. 11A and 11B generally illustrate a fastener at least partially surrounded by the combing isolator consistent with the present disclosure.
Figure 11B:
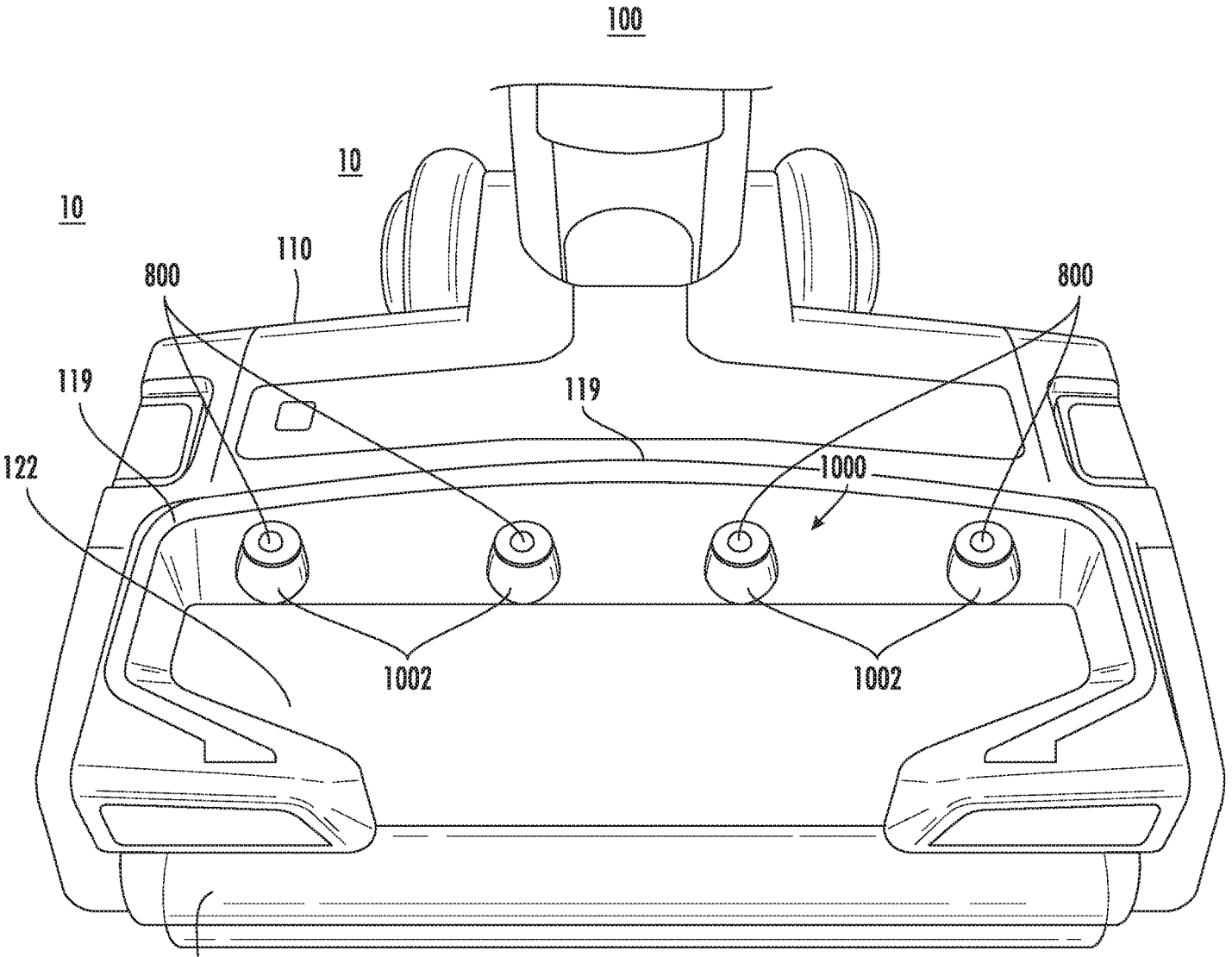

Alternatively (or in addition), the combing isolator 500 may be secured to the body 110 and/or the panel 119 by way of a clamp 1000 or the like as generally illustrated in FIGS. 10A and 10B. For example, one or more fasteners 800 may be configured to cause a compressive force to be applied by the combing isolator 500 and a clamping body 1002 against the body 110 and/or the panel 119 of the surface cleaning head 100. In at least one example, the clamping body 1002 may also be formed from a material configured to absorb vibration. By way of a non-limiting example, the clamping body 1002 may be formed from the same material as the combing isolator 500, though this is not a limitation of the present disclosure unless specifically claimed as such. In any of the examples disclosed herein, the fasteners 800 may be at least partially surrounded by the combing isolator 500, for example, as generally illustrated in FIGS. 11A and 11B. In particular, at least a portion 1100 of the combing isolator 500 may be disposed between the fasteners 800 and the body 110 and/or the panel 119 of the surface cleaning head 100. The portion 1100 of the combing isolator 500 may be disposed coextensively between the fasteners 800 and the body 110 and/or the panel 119 such that the fasteners 800 do not directly contact the body 110 and/or the panel 119. A benefit of the clamping design is that it may further reduce vibration and noise compared to the fastening design of FIGS. 8-9 by increasing the isolation of the connection between the combing unit 149 and the body 110 and/or the panel 119 of the surface cleaning head 100.

Figure 12:
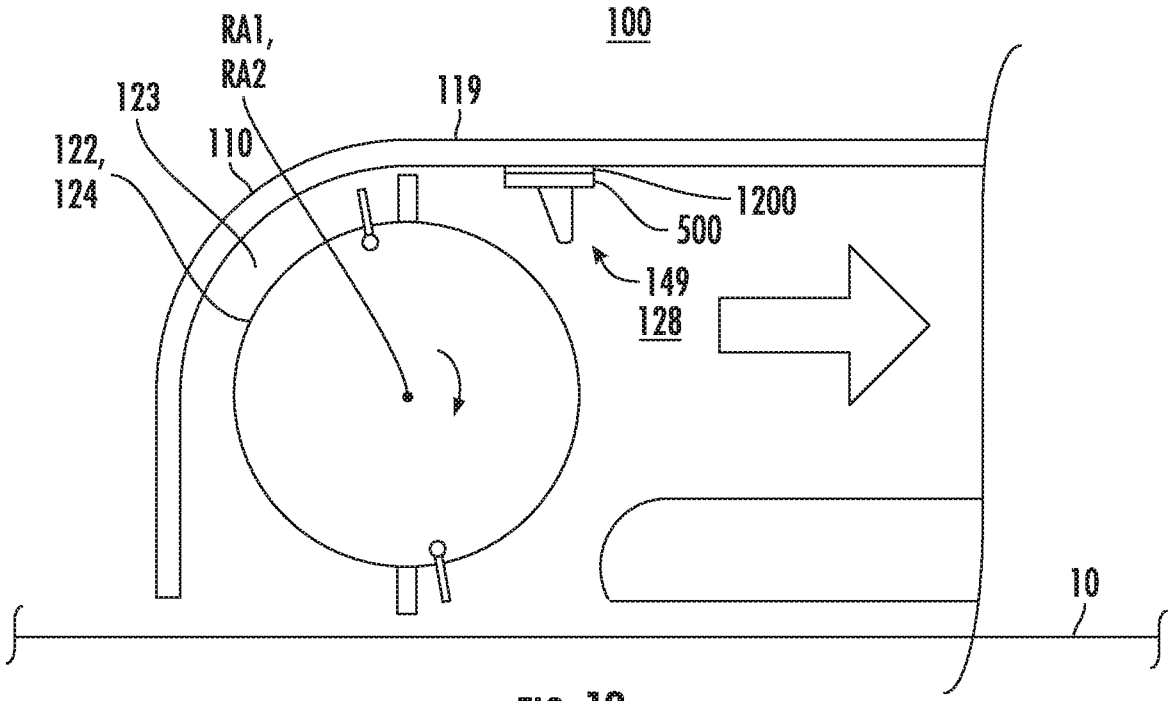
FIG. 12 generally illustrates one example of a combing isolator secured to the body and/or the panel of the surface cleaning head using an adhesive consistent with the present disclosure.

Turning now to FIG. 12, the combing isolator 500 may be secured to the body 110 and/or the panel 119 of the surface cleaning head 100 using an adhesive 1200, either alone or in combination with any of the other connections described herein. The adhesive 1200 may include any adhesive known to those skilled in the art. According to one example, the adhesive layer 1200 may be applied to the combing isolator 500 or the body 110 and/or the panel 119 of the surface cleaning head 100, and the exposed surface of the adhesive layer 1200 may include a removable backing (not shown). The adhesive 1200 may simplify the manufacturing process, reduce the number of parts and therefore lowering the cost of manufacture, and may increase the contact area between the combing isolator 500 and the body 110 and/or the panel 119.

Figure 13:
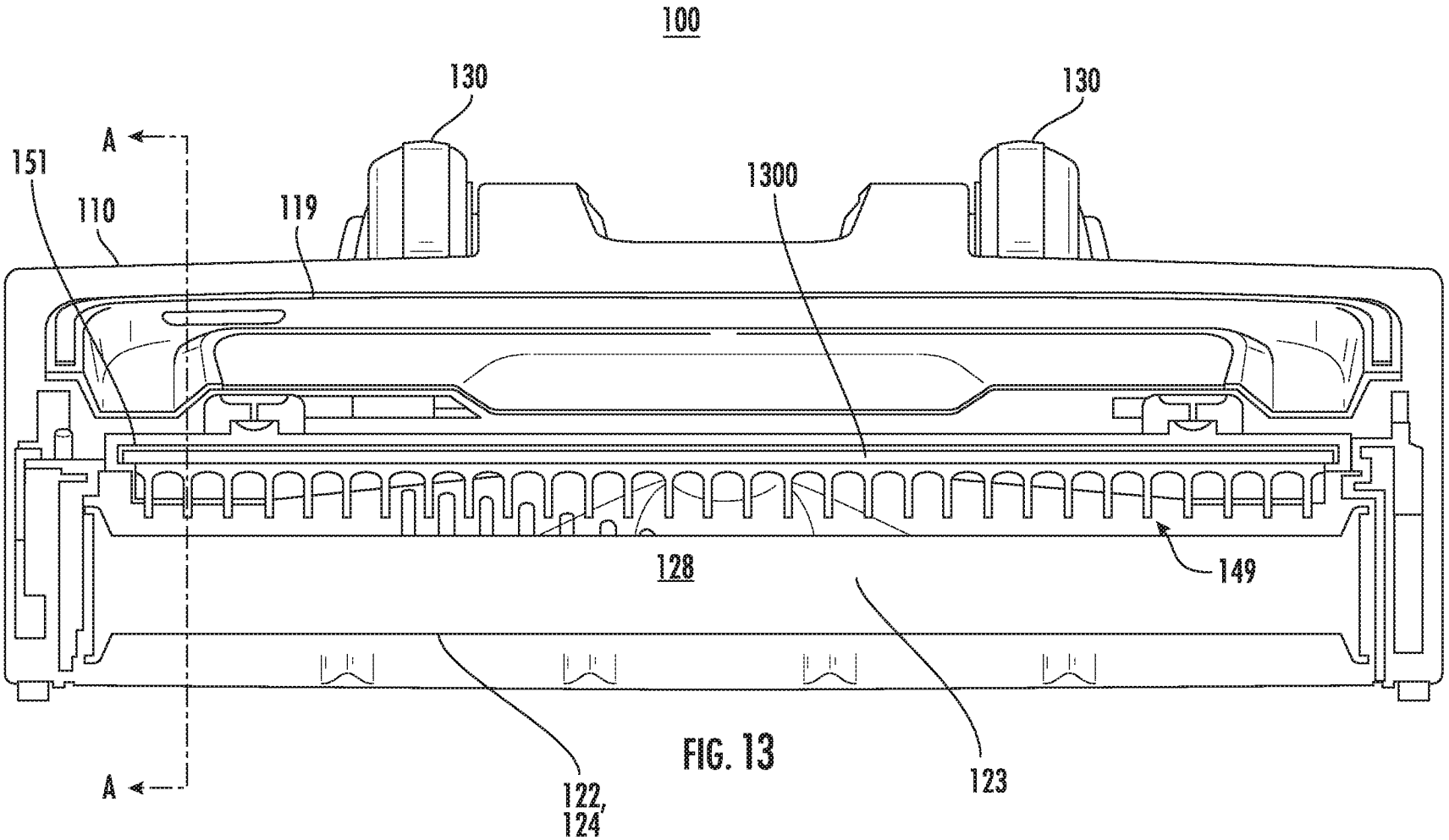
FIG. 13 generally illustrates a front cross-sectional View of one example of a surface cleaning head consistent with the present disclosure.
Figure 14:
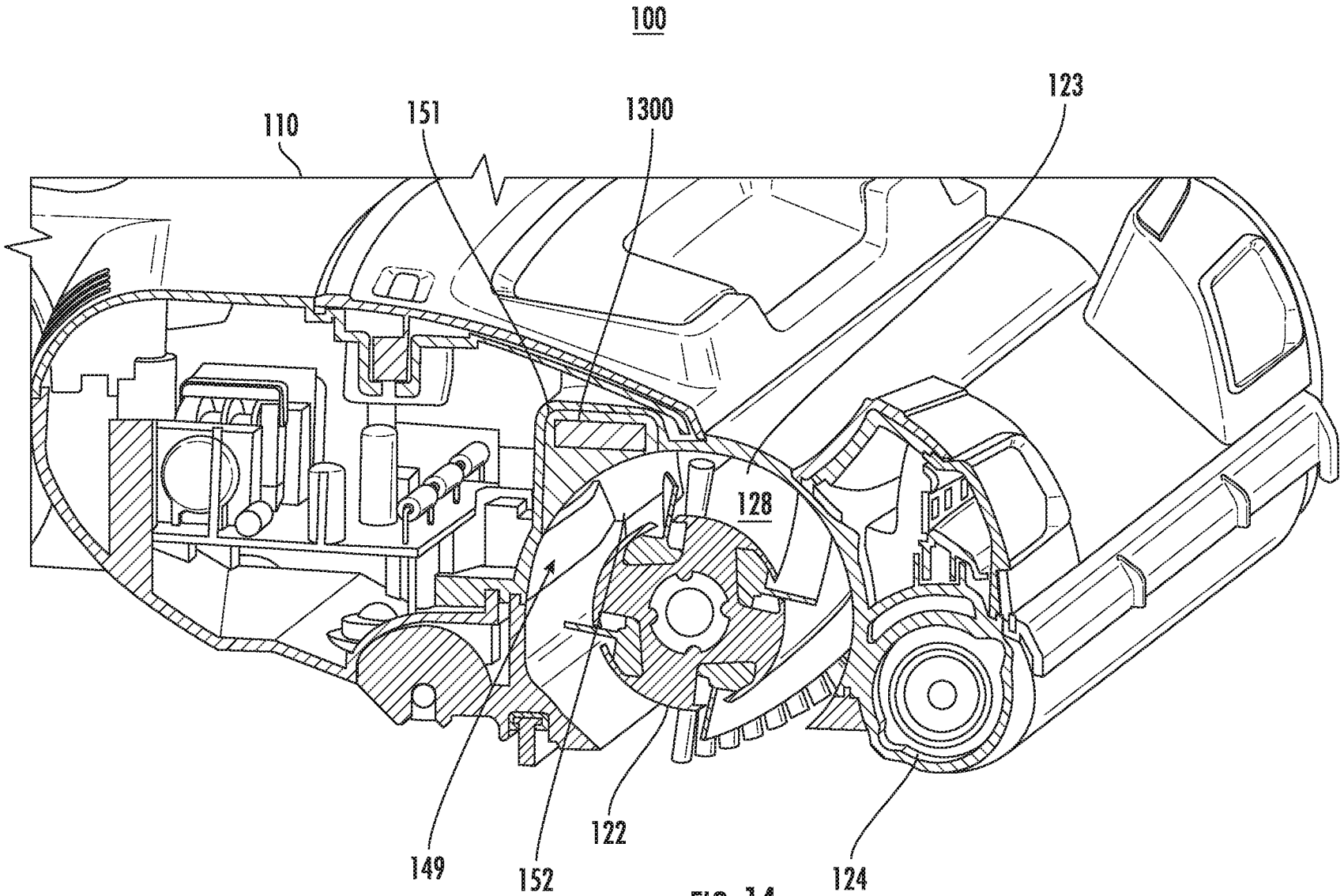
FIG. 14 is a cross-sectional View taken along lines A-A of FIG. 13.

Another example of a combing unit 149 is generally illustrated in FIGS. 13-14. In particular, FIG. 13 generally illustrates a front cross-sectional view of one example of a surface cleaning head 100, while FIG. 14 is a cross-sectional view taken along lines A-A of FIG. 13. The combing unit 149 may be used with or without any of the isolators 500 described herein. The combing unit 149 may include one or more ballasts 1300 configured to reduce vibration and/or noise generated by contact between the combing unit 149 and the agitator(s) 122, 124 by increasing the overall mass of the combing unit 149, thereby reducing the acceleration of the combing unit 149 as the combing unit 149 comes into contact with the rotating agitator(s) 122, 124. The ballast 1300 may be at least 75% of the overall weigh of the combing unit 149, for example, the ballast 1300 may be at least 80% of the overall weigh of the combing unit 149, the ballast 1300 may be at least 85% of the overall weigh of the combing unit 149, the ballast 1300 may be at least 90% of the overall weigh of the combing unit 149, and/or the ballast 1300 may be at least 95% of the overall weigh of the combing unit 149, including all values and ranges therein. By way of a non-limiting example, a combing unit 149 without a ballast 1300 may include a back support 151 and teeth/ribs 152 formed of plastic 149 having a weight of approximately 16.9 g, while a combing unit 149 having a ballast 1300 formed of metal (e.g., but not limited to, steel and/or brass) and a back support 151 and teeth/ribs 152 formed of plastic 149 may have a weight of approximately 48.1 g.

The ballast 1300 may be formed from a material having a higher density than the material of the back support 151 and/or teeth/ribs 152. For example, the back support 151 and/or the teeth/ribs 152 may be formed from a first material (such as, but not limited to, a plastic or the like) while the ballast 1300 may be formed from a second material having a higher density than the first material (such as, but not limited to, metal or the like).

The ballast 1300 may extend generally along the longitudinal length L of the combining unit 149 (e.g., the back support 151). For example, the ballast 1300 may extend substantially continuously with (e.g., coextensive with) the combing unit 149 (e.g., the back support 151). Alternatively, the ballast 1300 may be disposed along and/or within one or more discrete portions of the combining unit 149 (e.g., the back support 151). For example, a plurality of discrete and separate ballasts 1300 may be spaced apart from adjacent ballasts 1300.

Figure 15:
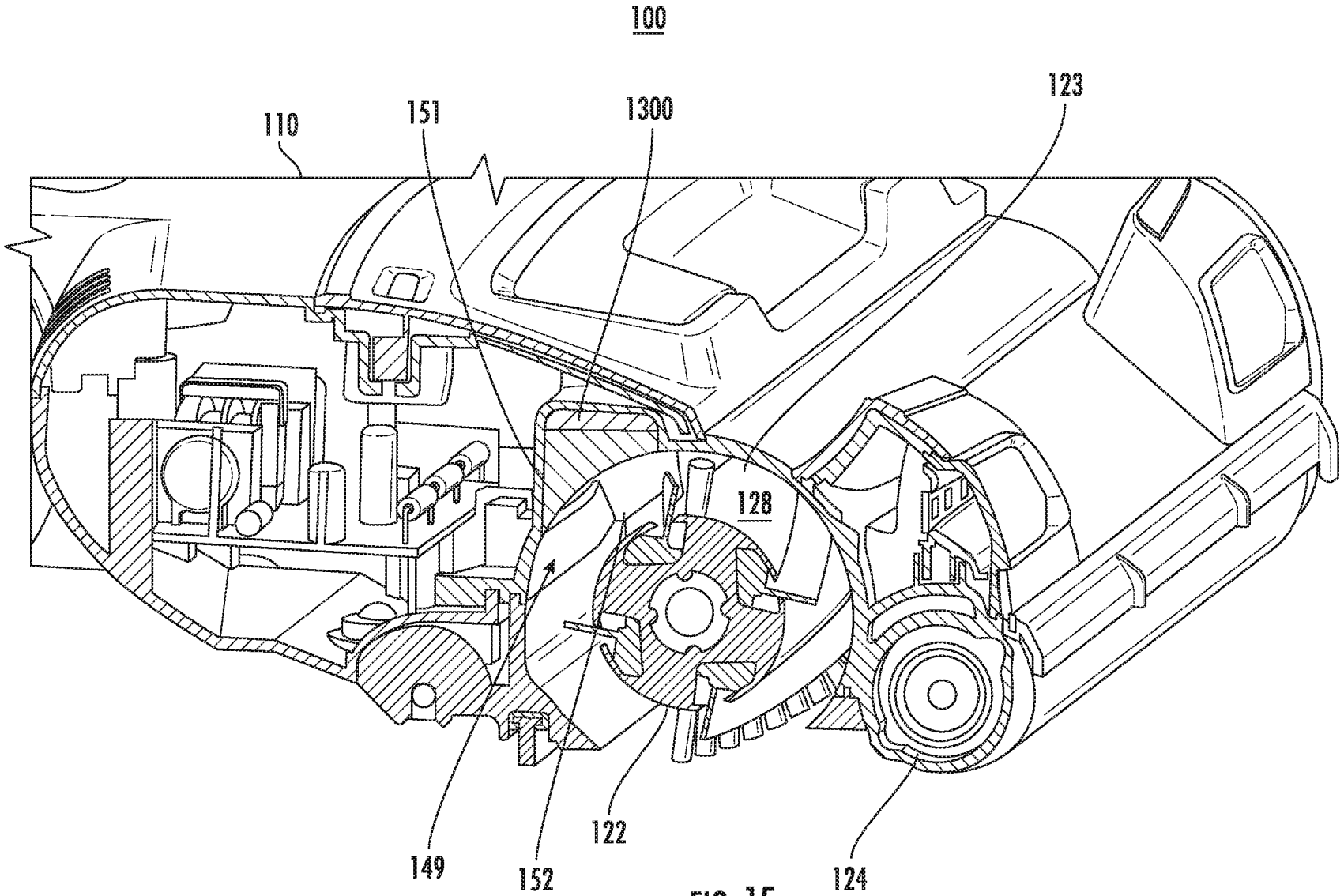
FIG. 15 generally illustrates one example of a ballast coupled to the back support without being encapsulated, consistent with the present disclosure.

The ballast 1300 may be at least partially encapsulated by the back support 151 of the combing unit 149 as generally illustrated in FIGS. 13 and 14. For example, the back support 151 and the teeth/ribs 152 may be formed from the first material, while the ballast 1300 may be formed from the second material. Alternatively, the ballast 1300 may be coupled to the back support 151 without being encapsulated, for example, as generally illustrated in FIG. 15.

Figure 16:
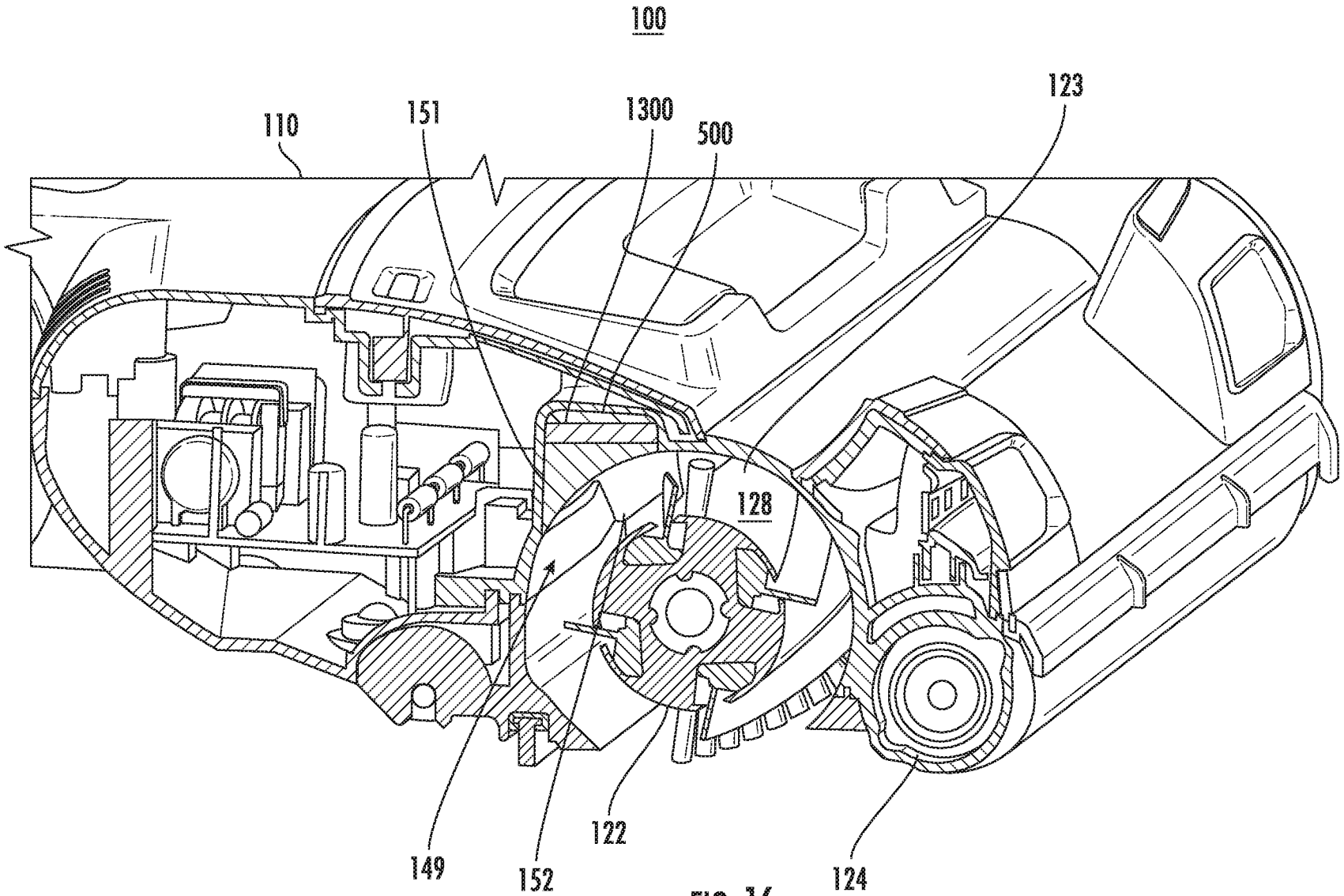
FIG. 16 generally illustrates another example of a ballast consistent with the present disclosure.

As described above, the ballast 1300 may optionally be combined with any of the isolators 500 described herein, e.g., as generally illustrated in FIG. 16. Testing has shown that the combination of the ballast 1300 and the combing isolator 500 works in unison, and results in a syngeneic benefit to reduce noise. In addition, the ballast 1300 may increase the overall stiffness of the combing unit 149, thereby reducing and/or preventing warping of the combing unit 149 that could lead to misalignment between combing unit 149 and the agitator 122, 124. As may be appreciated, misalignment of the combing unit 149 can cause undesirable effects to antiwrap performance and system durability.

As noted herein, the surface cleaning head 100 may include one or more removable and/or hinged panels 119, for example, that allow one or more of the agitators 122, 124 to be removed. The surface cleaning head 100 may include one or more panel isolators 1700, FIGS. 17-18, configured to extend around at least a portion of the periphery or contact portion 1702 of at least one component of the panel 119. Similar to the combing isolator 500, the panel isolator 1700 may be at least partially formed from a material configured to absorb vibration caused by contact between the combing unit 149 and the agitator(s) 122, 124 due to rotation of the agitator(s) 122, 124. For example, the panel isolator 1700 may convert vibrational energy from the combing unit 149 into heat, thereby reducing the transfer of vibrational energy to the surface cleaning head 100 (e.g., the body 110 and/or the panel 119).

With reference to FIG. 1, the panel 119 may include one or more portions configured to be moveably and/or hingedly coupled to the housing 110. The panel 119 may optionally include one or more windows 105. The window 105 may be removably coupled to a panel frame 107. As such, the panel 119 may be considered to have at least two components, i.e., the window 105 and the panel frame 107. Alternatively, the window 105 may be an integral component with the panel frame 107.

Figure 17:
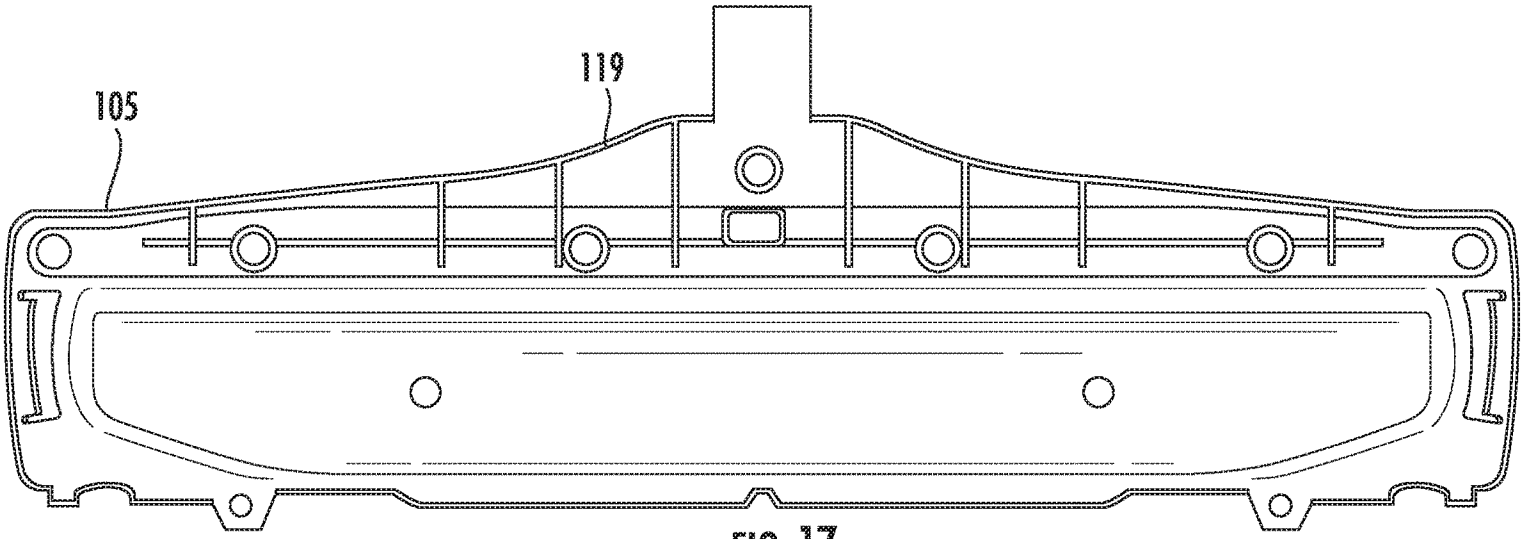
FIGS. 17-18 generally illustrate examples of the surface cleaning head including one or more panel isolators consistent with the present disclosure.
Figure 18:
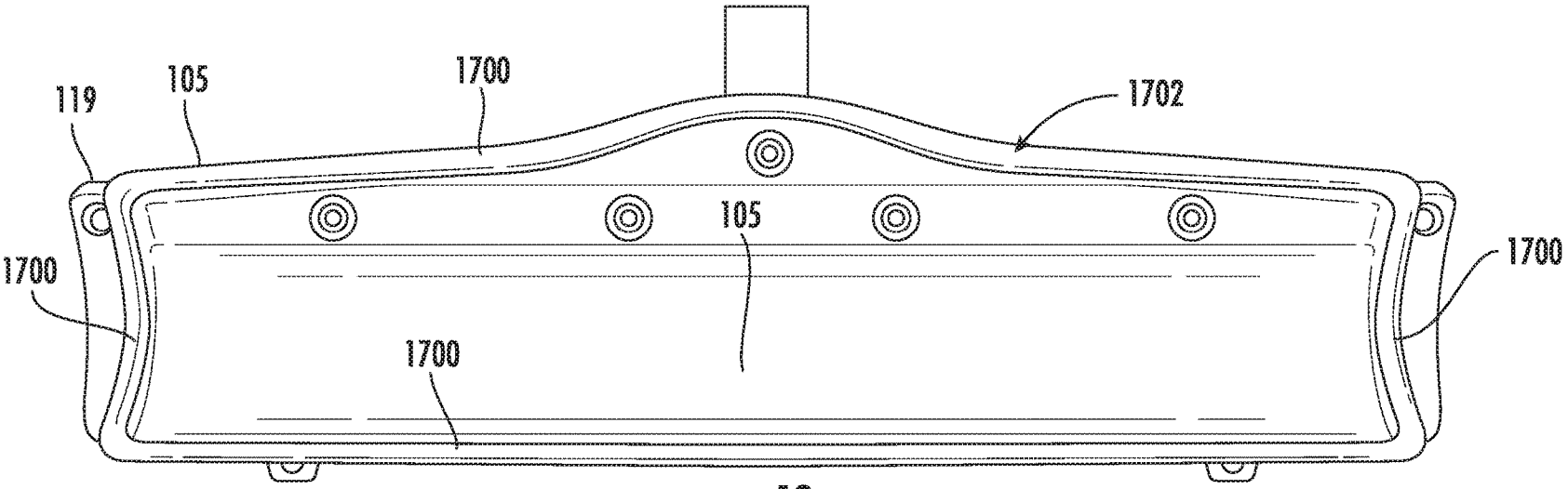
Figure 19:
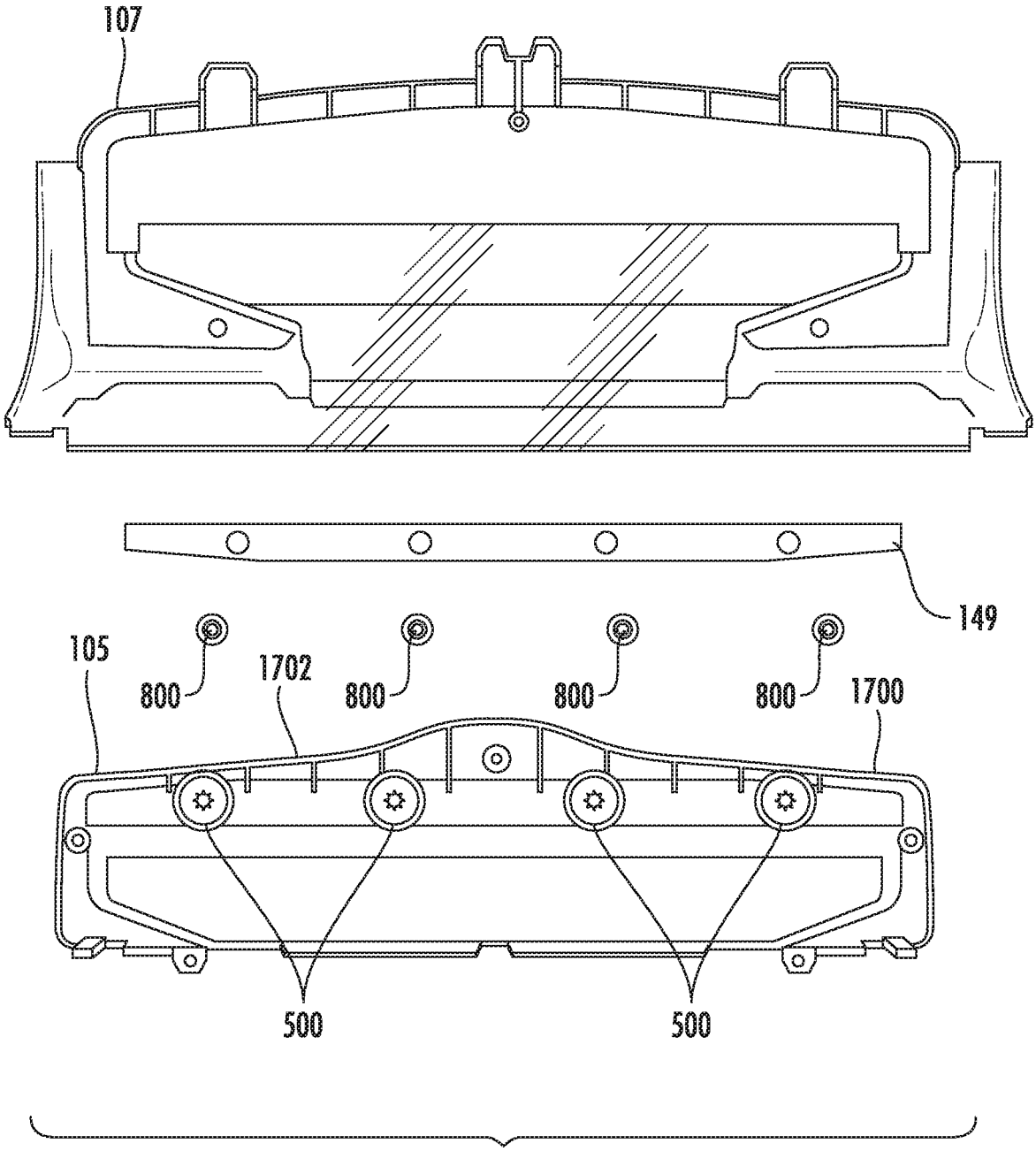
FIGS. 19-23 generally illustrate examples of a panel isolator disposed at least partially between at least a portion of the panel and the housing, and the combing unit secured to the panel with a combing isolator consistent with the present disclosure.
Figure 20:
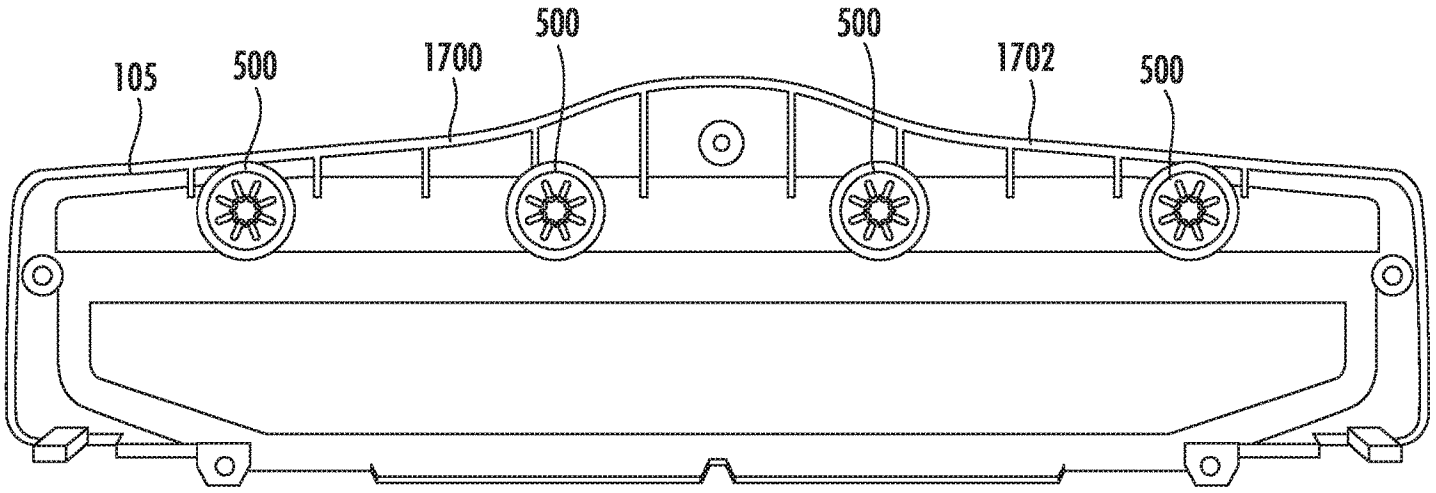
Figure 21:
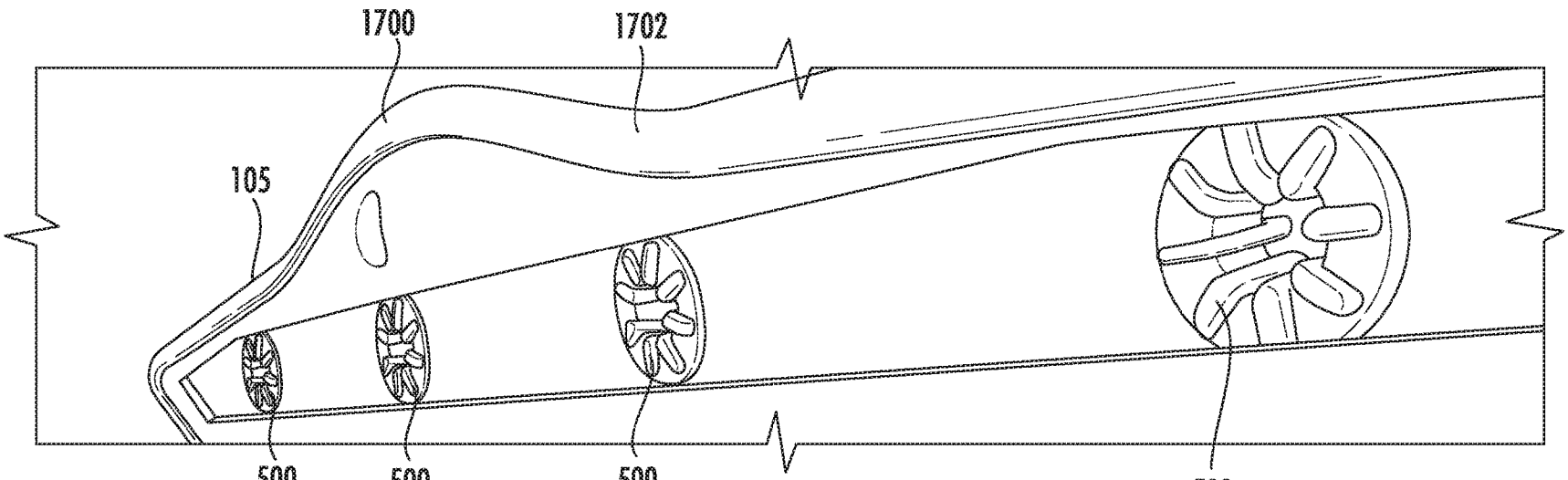
Figure 22:
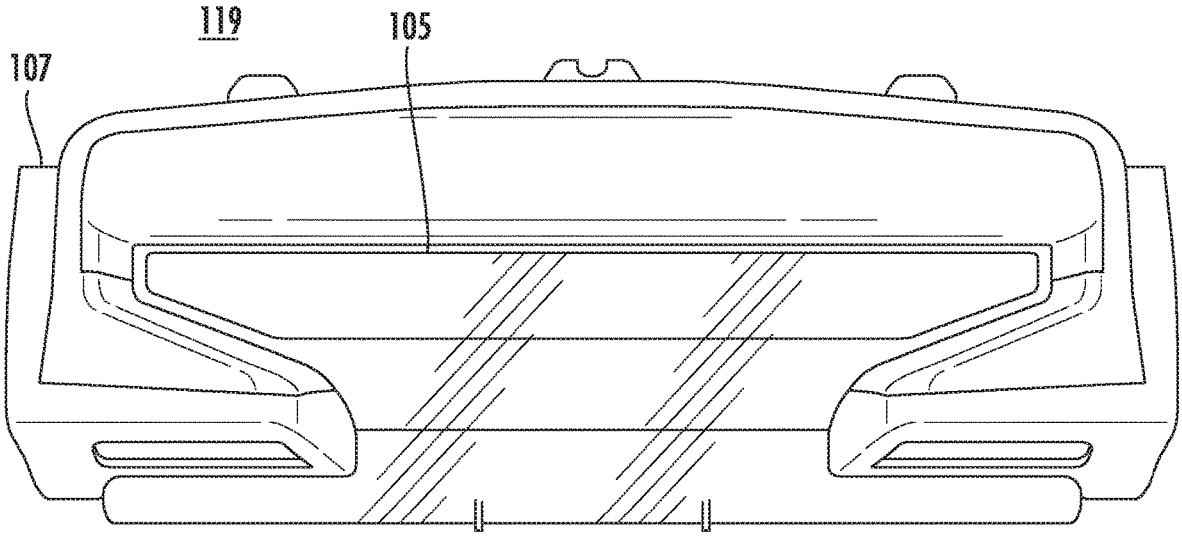
Figure 23:
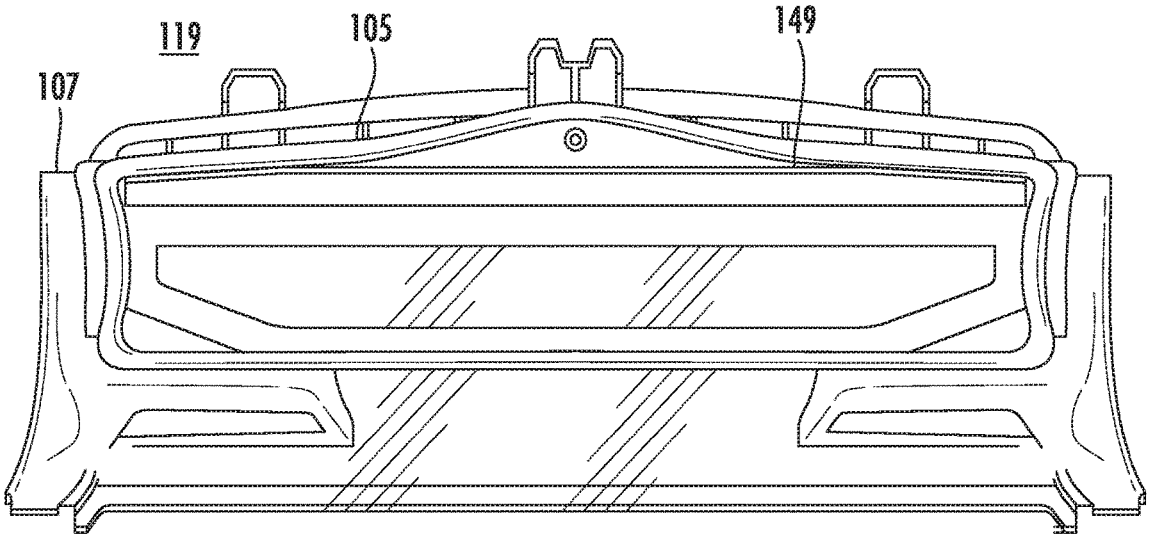

As noted above, the surface cleaning head 100 may include one or more panel isolators 1700, FIGS. 17-18, configured to extend around at least a portion of the periphery or contact portion 1702 of at least a portion of the panel 119 (e.g., the window 105 and/or panel frame 107). For example, one or more panel isolators 1700 may be disposed at least partially between the panel 119 and the housing 110 to which the panel 119 is configured to be secured. In at least one example, one or more panel isolators 1700 are disposed at least partially between the panel frame 107 and the housing 110. Alternatively (or in addition), one or more panel isolators 1700 may be disposed at least partially between the window 105 and the panel frame 107.

In the illustrated example, a single panel isolator 1700 extends around the entire periphery or contact portion 1702 of the window 105 of the panel 119. Alternatively, one or more panel isolators 1700 may extend along one or more discrete and separate portions between the periphery or contact portion 1702 of the window 105 of the panel 119. For example, a plurality of discrete and separate panel isolators 1700 may be spaced apart from adjacent isolators. The panel isolator(s) 1700 may therefore be disposed between the window 105 and the panel housing 107 such that the window 105 generally does not directly contact the panel frame 107 with the exception of one or more fasteners and/or hinges that secure the window 105 to the panel frame 107. While the panel isolator 1700 is shown extending along the periphery or contact portion 1702 of the window 105 of the panel 119, one or more panel isolators 1700 may extend along the periphery or contact portion 1702 of the panel frame 107 of the panel 119 which is adjacent to the window 105 and/or may extend along the periphery or contact portion 1702 of the panel frame 107 of the panel 119 which is adjacent to the housing 110.

According to one example, the panel isolator 1700 may be disposed between the panel 119 and the housing 110 such that the panel 119 generally does not directly contact the housing 110, but rather is coupled to the housing 110 through the panel isolator 1700. For example, the panel isolator(s) 1700 may be disposed between the panel 119 and the housing 110 such that the panel 119 generally does not directly contact the housing 110, with the possible exception of one or more fasteners and/or hinges that secure the panel 119 to the housing 110. According to another example, the panel isolator(s) 1700 may be disposed between the panel 119 and the housing 110 such that the panel 119 does not directly contact the housing 110, but rather is coupled to the housing 110 through the panel isolator 1700.

In at least one example, the combing unit 149 may be secured to the housing 110 and/or panel 119 without a combing isolator 500 therebetween as generally illustrated in FIGS. 17-18. For example, the combing unit 149 may be directly secured to any part of the housing 110 and/or the panel 119 using one or more fasteners, adhesives, or the like. The combing unit 149 may also be formed as an integral and/or unitary component with the housing 110 and/or the panel 119 (e.g., the combing unit 149 may be formed/molded with the housing 110 and/or the panel 119). One or more panel isolators 1700 may be at least partially disposed between at least a portion of the panel 119 (e.g., the window 105 and/or panel frame 107) and the housing 110 (e.g., between the periphery or contact portion 1702 and the housing 110) to absorb vibration caused by contact between the combing unit 149 and the agitator(s) 122, 124 due to rotation of the agitator(s) 122, 124. It should be appreciated that in any examples described herein, the panel 119 may or may not be removably coupled to the housing 110.

According to another example, at least one panel isolator 1700 may be disposed at least partially between at least a portion of the panel 119 (e.g., the window 105 and/or panel frame 107) and the housing 110, and the combing unit 149 may also be secured to the panel 119 with a combing isolator 500, for example, as generally illustrated in FIGS. 19-23. In the illustrated example, the combing unit 149 is secured to the window 105 by way of a plurality of rubberized grommets and fasteners 800 (e.g., but not limited to, shoulder screws). It should be appreciated, however, that the combing unit 149 may be coupled to the panel 119 using any of the isolators 500 disclosed herein. The combination of combing isolators 500 and panel isolators 1700 may enhance the vibration and noise reduction compared to either combing isolators 500 and panel isolators 1700 alone. Additionally, the combing unit 149 including a ballast 1300 may also be used with either combing isolators 500 and/or panel isolators 1700.

Figure 24:
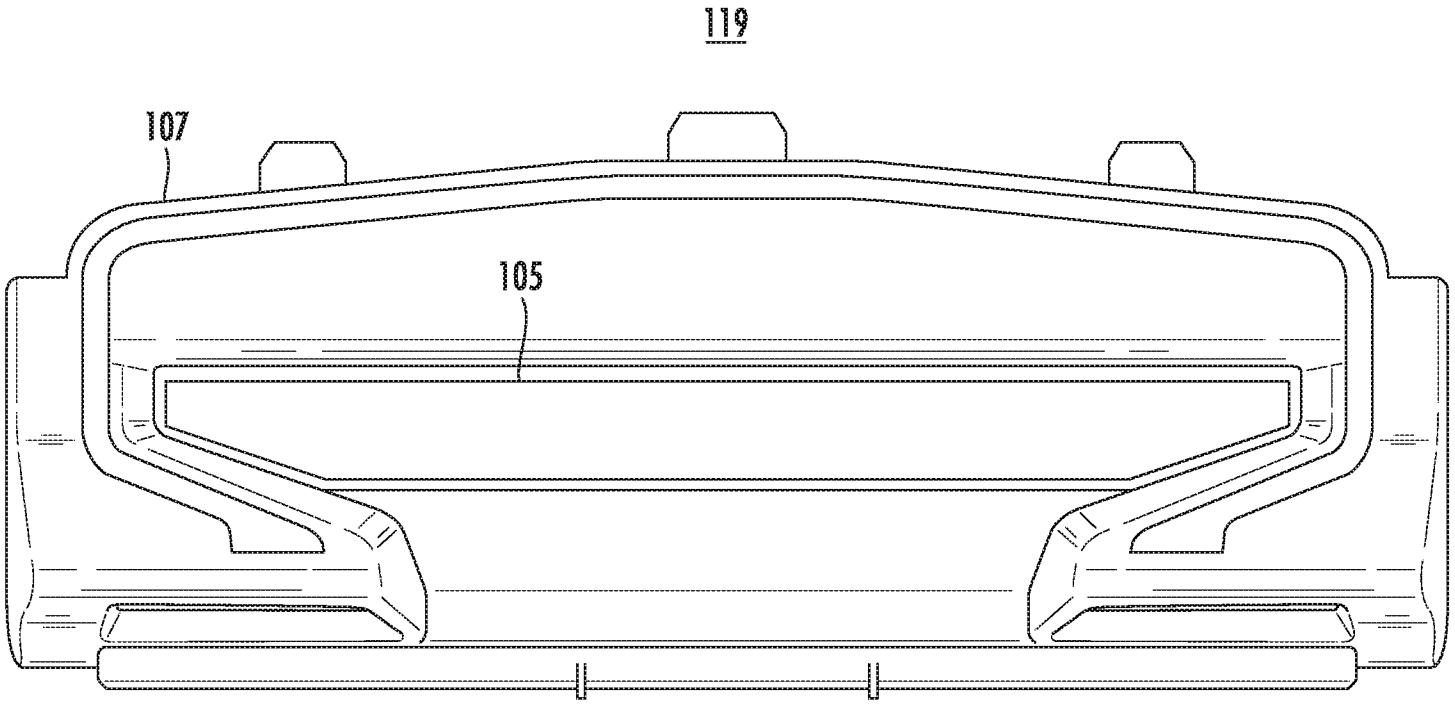
FIGS. 24-26 generally illustrate examples of a system including both panel and combing isolators consistent with the present disclosure.
Figure 25:
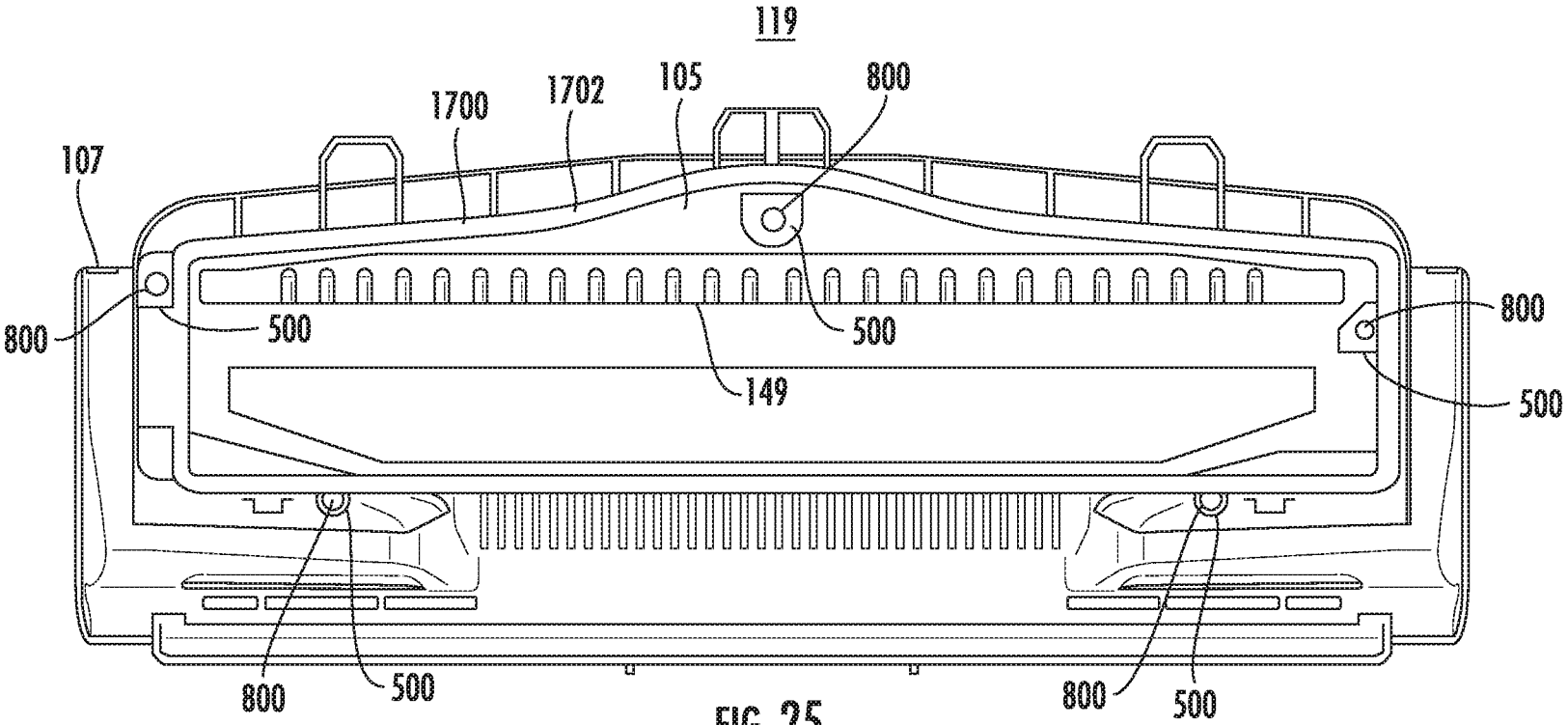
Figure 26:
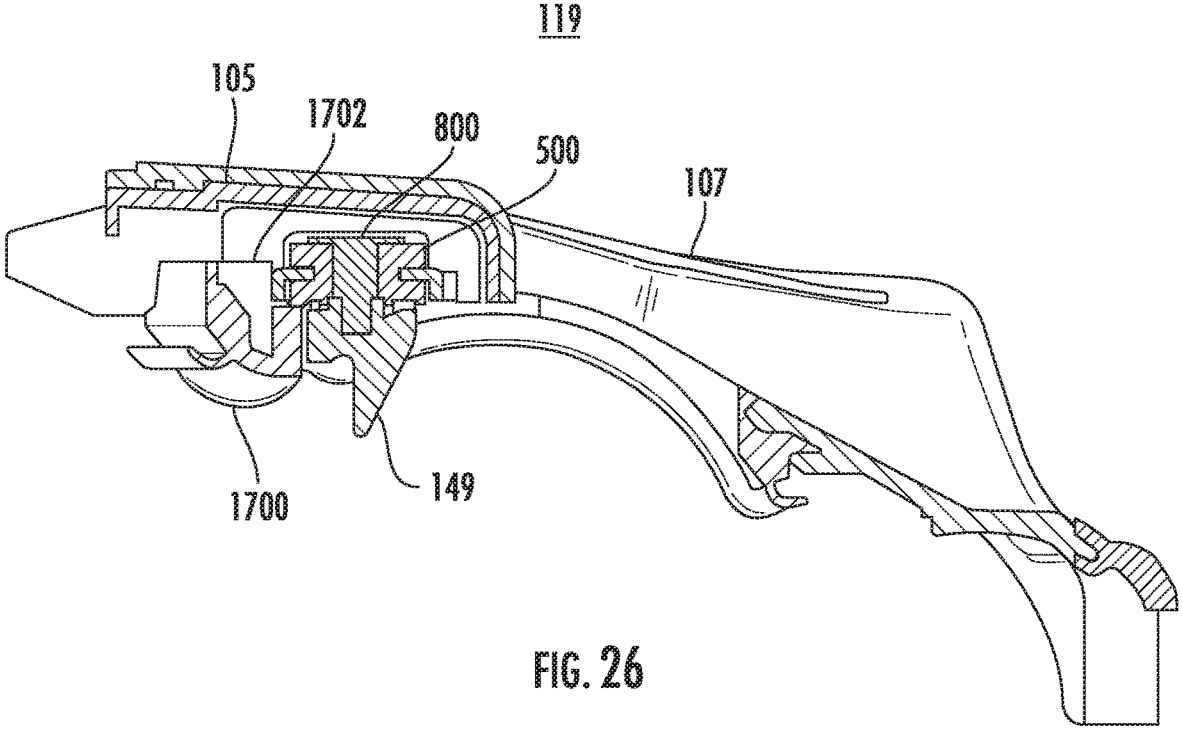
Figure 27:
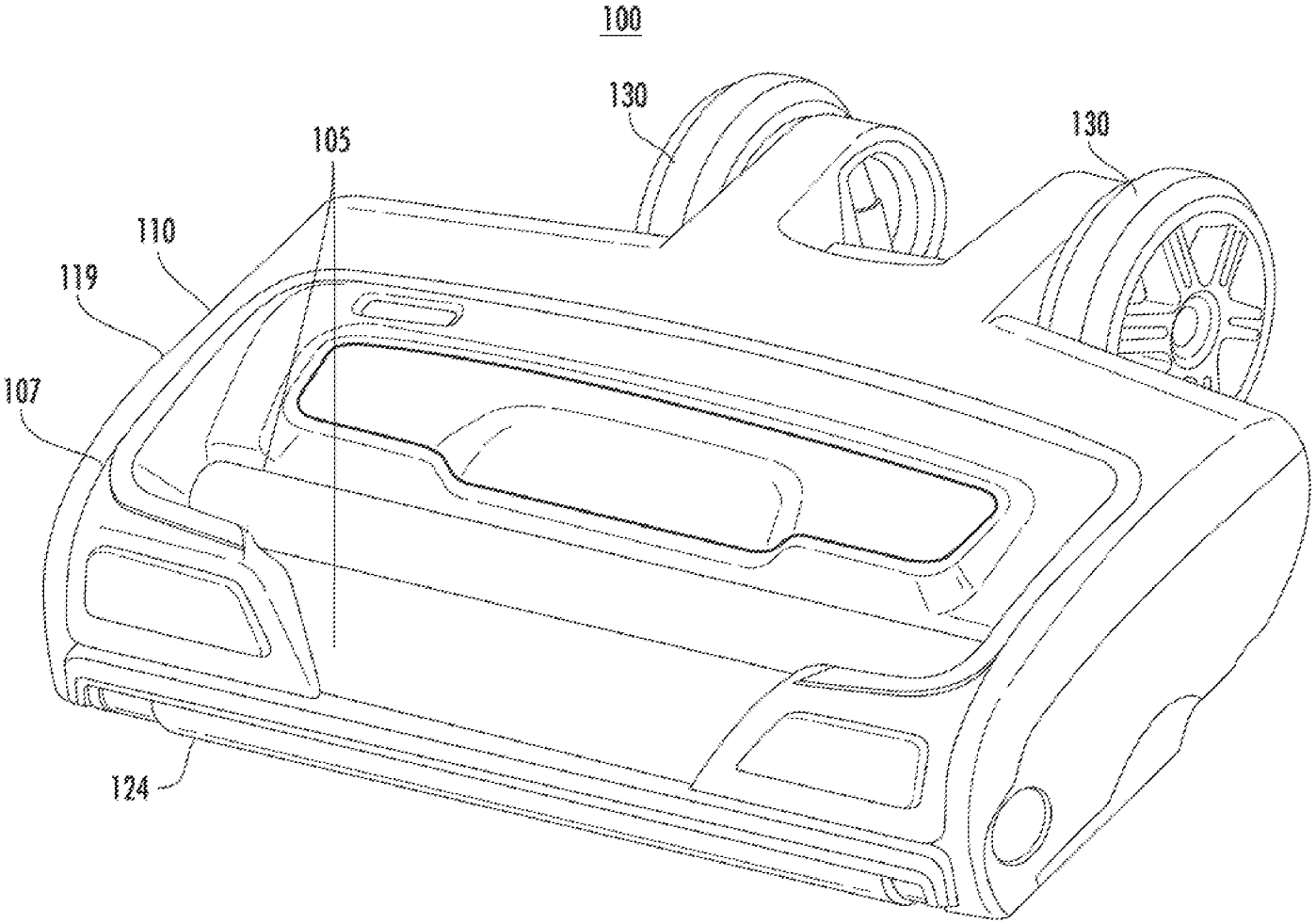
FIGS. 27-30 generally illustrate examples of a surface cleaning head including a non-removable panel consistent with the present disclosure.
Figure 28:
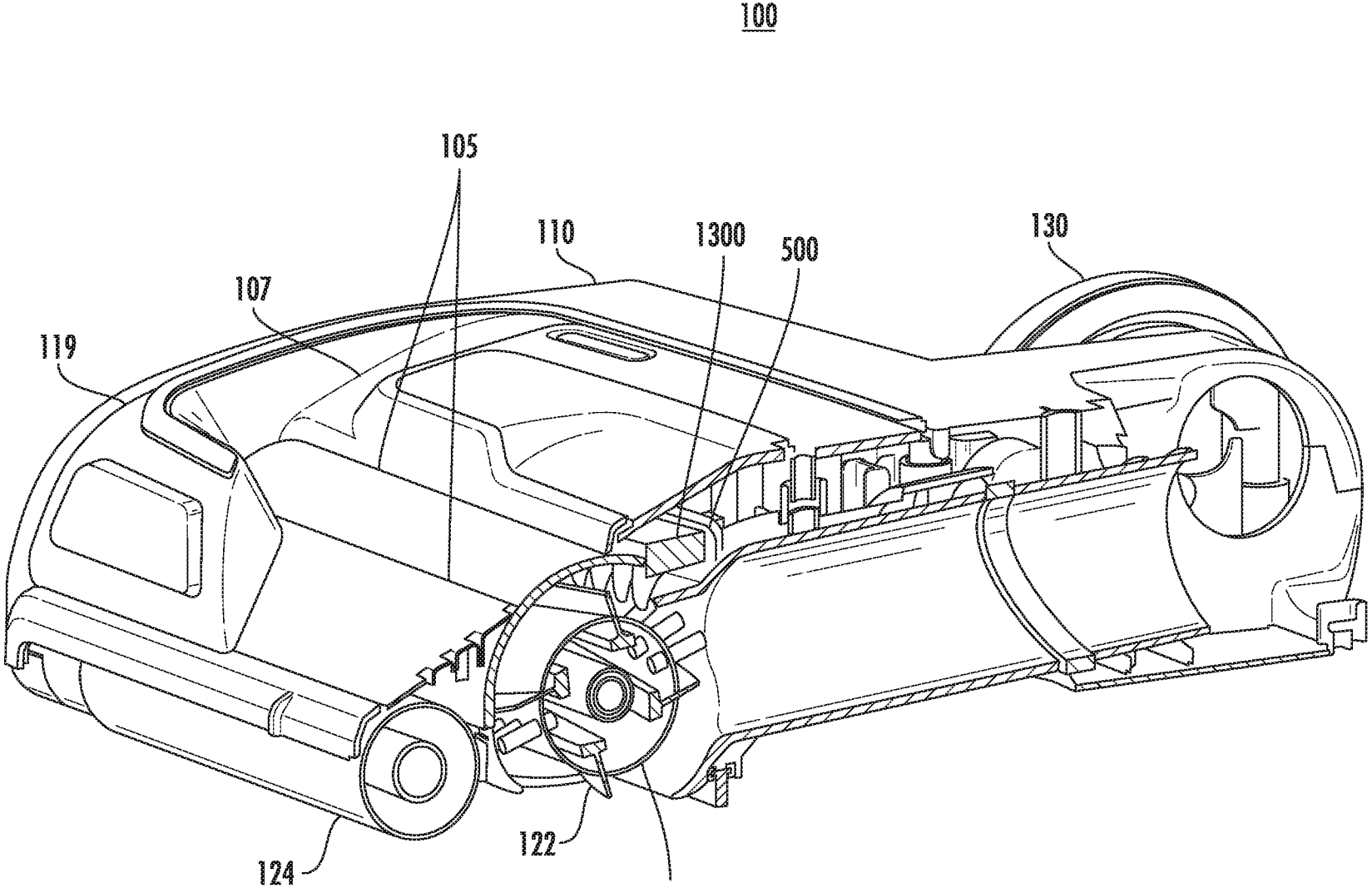
Figure 29:
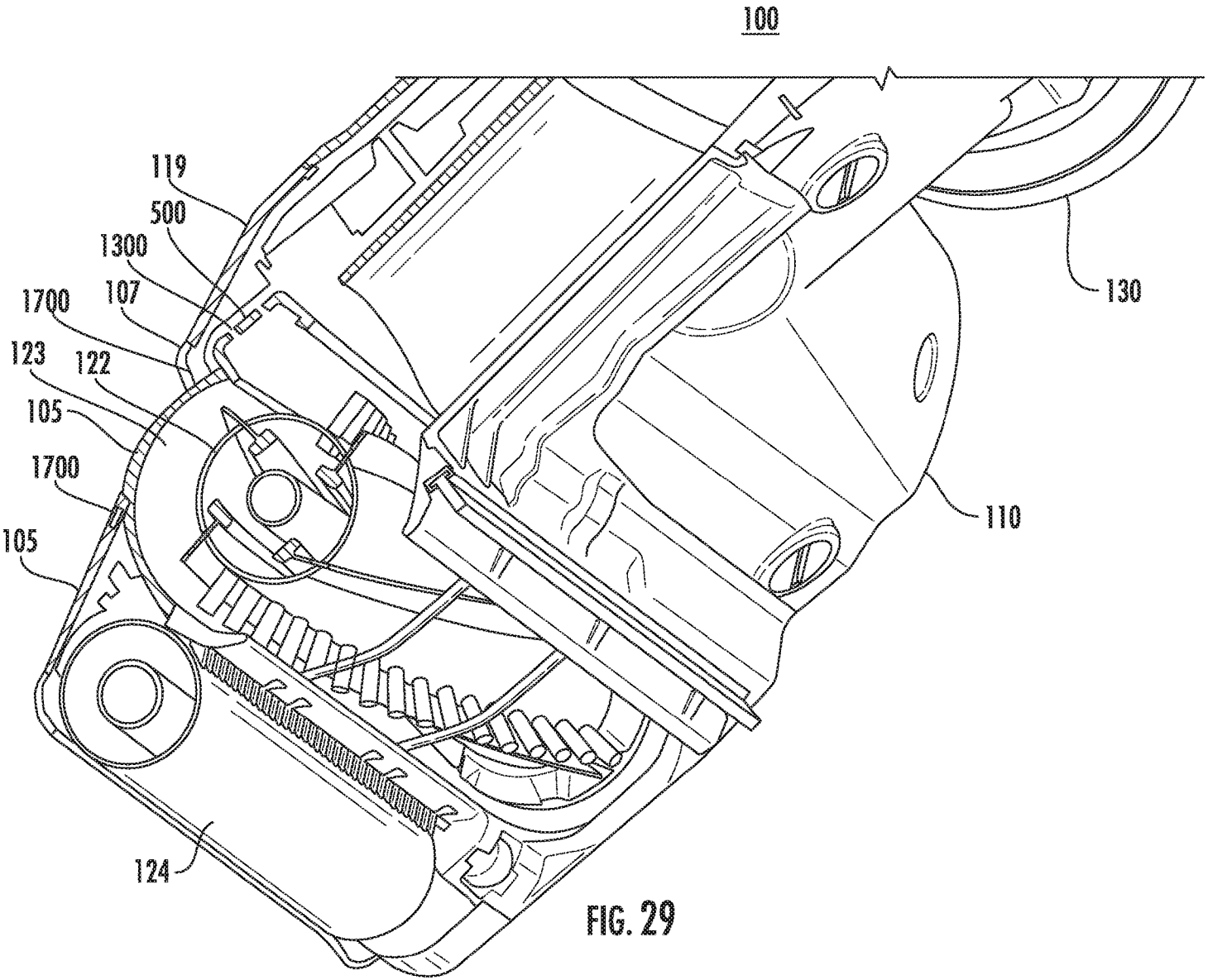
Figure 30:
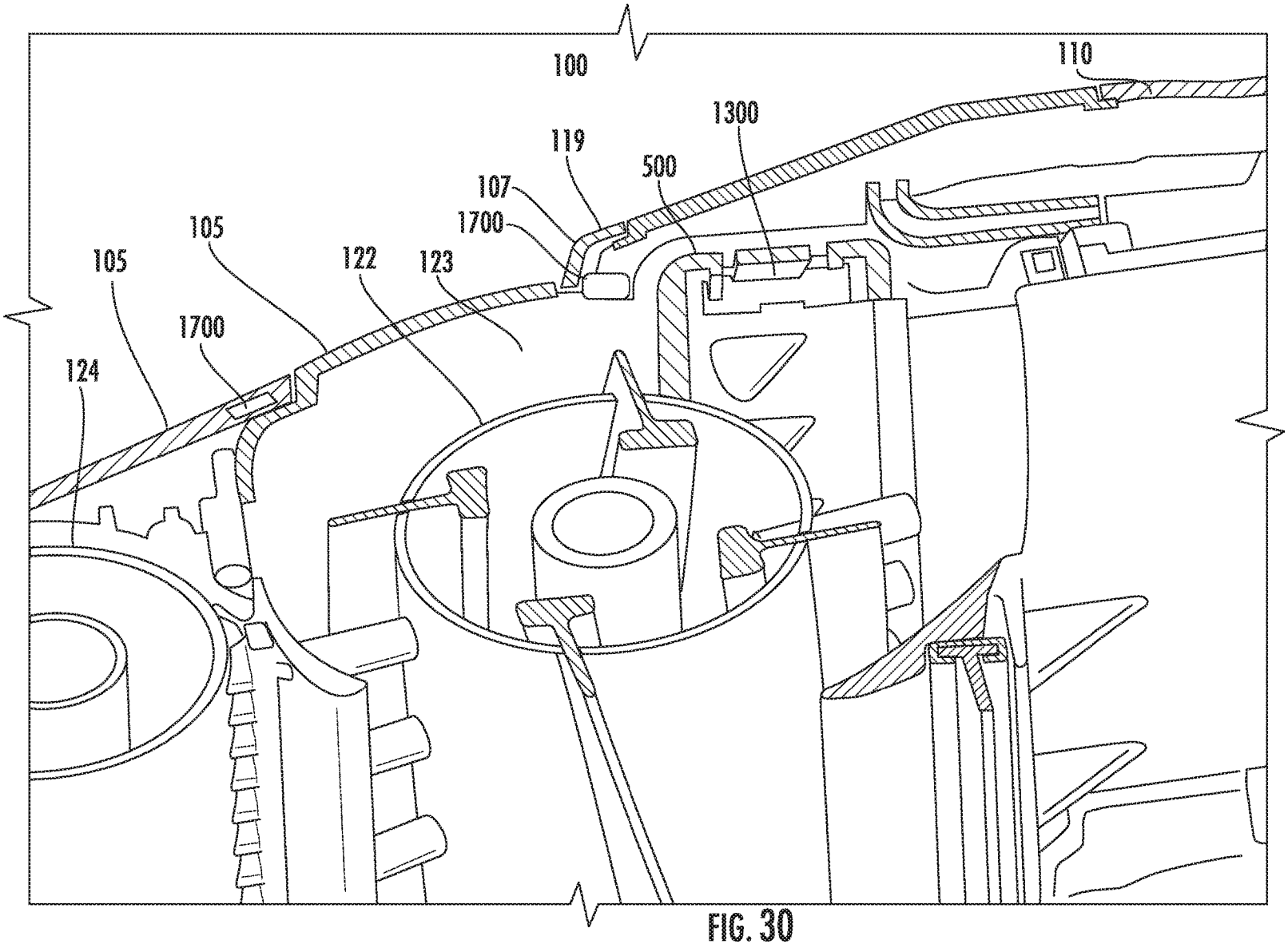

Another example of a system including both isolators 500 and 1700 is generally illustrated in FIGS. 24-26. The panel isolator 1700 may optionally form a seal between the window 105 and the panel frame 107 and/or a seal between the panel 119 (e.g., the panel frame 107) and the housing 110. The combing unit 149 may optionally include a ballast 1800.

Turning now to FIGS. 27-30, one example of a surface cleaning head 100 including a non-removable panel 119 is generally illustrated. The non-removable panel 119 may be coupled to the housing 110 such that the panel 119 cannot be removed without destroying and/or dissembling the surface cleaning head 100 (i.e., the panel 119 is not intended to be removed by the user). For example, the panel 119 bonded to the housing 110 (e.g., using an adhesive, welding, or the like) and/or may be integrally formed with the housing 110. The panel 119 may optionally include one or more at least partially transparent and/or translucent windows 105 (note that while the figures show the window 105 as solid, this is merely for illustrative purposes only). The window 105 may allow one or more of the agitators 122, 124 to be at least partially visible from the top of the surface cleaning head 100. The window 105 may be removably coupled to a panel frame 107. As such, the panel 119 may be considered to have at least two components, i.e., the window 105 and the panel frame 107. Alternatively, the window 105 may be an integral component with the panel frame 107.

One or more combing isolators 500 may be at least partially disposed between the combing unit 149 and the housing 110 and/or the panel 119 (e.g., but not limited to, the window 105 and/or the panel frame 107). The combing isolator 500 may be coupled to the combing unit 149 and the housing 110 and/or the panel 119 using any mechanism described herein. By way of a non-limiting example, the combing isolator 500 may be coupled to the combing unit 149 and the housing 110 and/or the panel 119 using an adhesive and/or welding.

The combining unit 149 may optionally include one or more ballasts 1300 as described herein. Additionally (or alternatively), one or more panel isolators 1700 may be at least partially disposed between the panel 119 (e.g., the window 105 and/or the panel frame 107) may be coupled and the housing 110. As described herein, the panel 119 may be non-removably coupled to the housing 110, however, in at least one example, the panel 119 may still be able to move slightly relative to the housing 110 to reduce the transmission of vibration and/or reduce the amount of noise generated by the interaction between the combining unit 149 and the agitators 122, 124. The panel isolators 1700 may also optionally produce a seal between the panel 119 and the housing 110 to increase the suction force within the agitation chamber 123.

Figure 31:
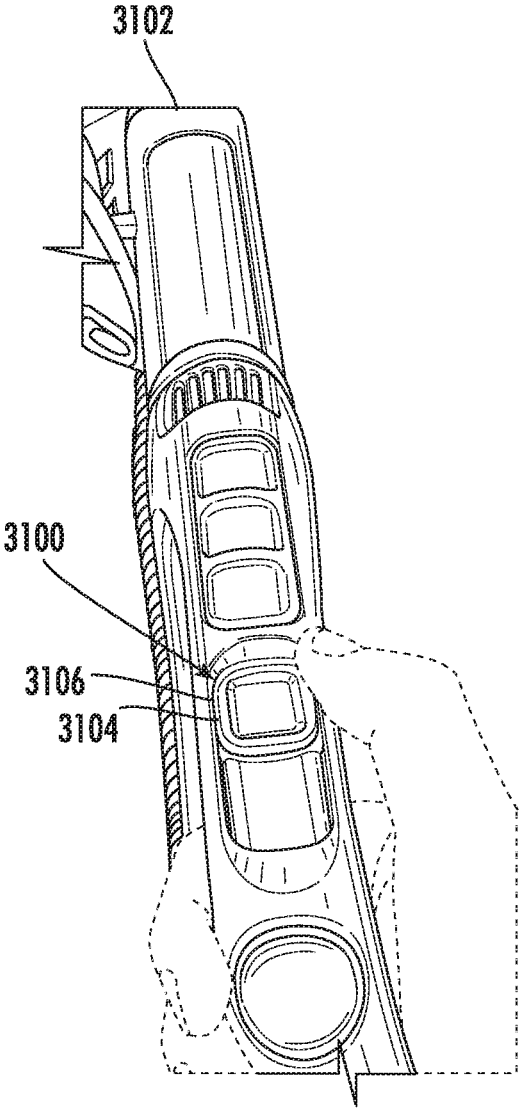
FIG. 31 generally illustrates one example of an adiustable bleed valve consistent with the present disclosure.

Turning now to FIG. 31, the present disclosure may also feature an adjustable bleed valve 3100. The adjustable bleed valve 3100 may be located anywhere; however, it at least one example the adjustable bleed valve 3100 is located on a handle 3102. The adjustable bleed valve 3100 may be configured to allow a user to select a desired amount of suction through the opening 127 and/or dirty air inlet 129 (e.g., FIG. 1). For example, the air flow through dirty air inlet 129 may be reduced by opening the adjustable bleed valve 3100 since some of the air flow will flow through the adjustable bleed valve 3100 and be diverted from the opening 127 and/or dirty air inlet 129. Conversely, the air flow through the opening 127 and/or dirty air inlet 129 may be increased by closing the adjustable bleed valve 3100. In addition to adjusting the air flow through the opening 127 and/or dirty air inlet 129, the adjustable bleed valve 3100 may also be used to reduce the noise level. In particular, the noise level may be decreased by closing the adjustable bleed valve 3100. As may be appreciated, air flowing through the adjustable bleed valve 3100 may generate noise proximate to the user, particularly if the adjustable bleed valve 3100 is located on the handle 3102 which is close to the user. Closing the adjustable bleed valve 3100 reduces the air flow through the adjustable bleed valve 100, thereby reducing the noise levels near the user. The adjustable bleed valve 3100 may be infinitely adjustable within a range and/or may include a plurality of preset positions (e.g., fully open, fully closed, and/or partially open. The fully closed position of the adjustable bleed valve 3100 may correspond to a max carpet cleaning mode. In at least one example, the adjustable bleed valve 3100 may include a slider 3104 that moves along to open/close an air inlet 3106; however, this is merely one example and the adjustable bleed valve 3100 may include any valve known to those skilled in the art. The adjustable bleed valve 3100 may be used alone or in combination with one or more of the isolators 500, 1700 and/or the ballast 1800 to further reduce noise levels.

Figure 32:
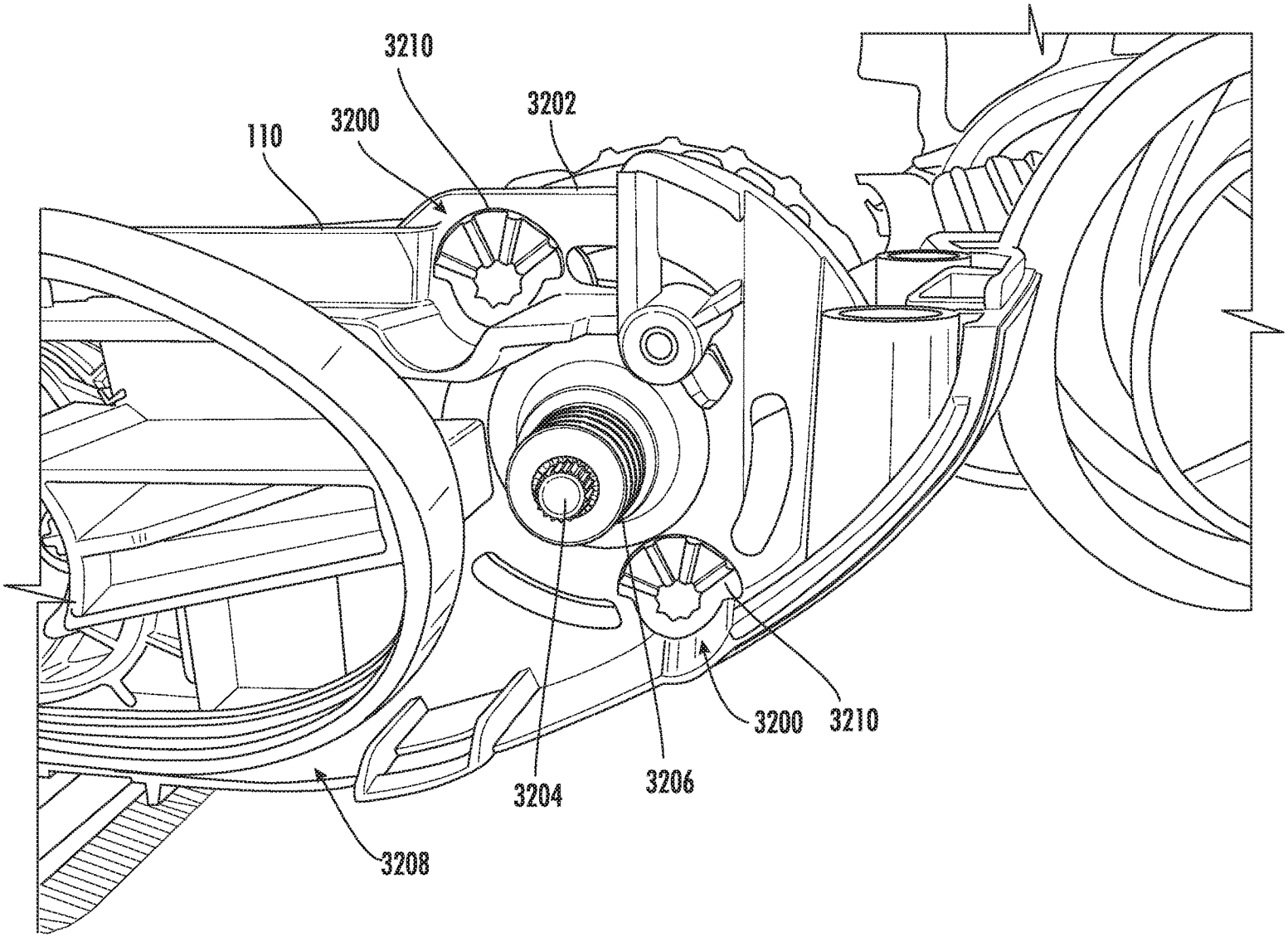
FIG. 32 generally illustrates one example of a motor isolators consistent with the present disclosure.
Figure 33:
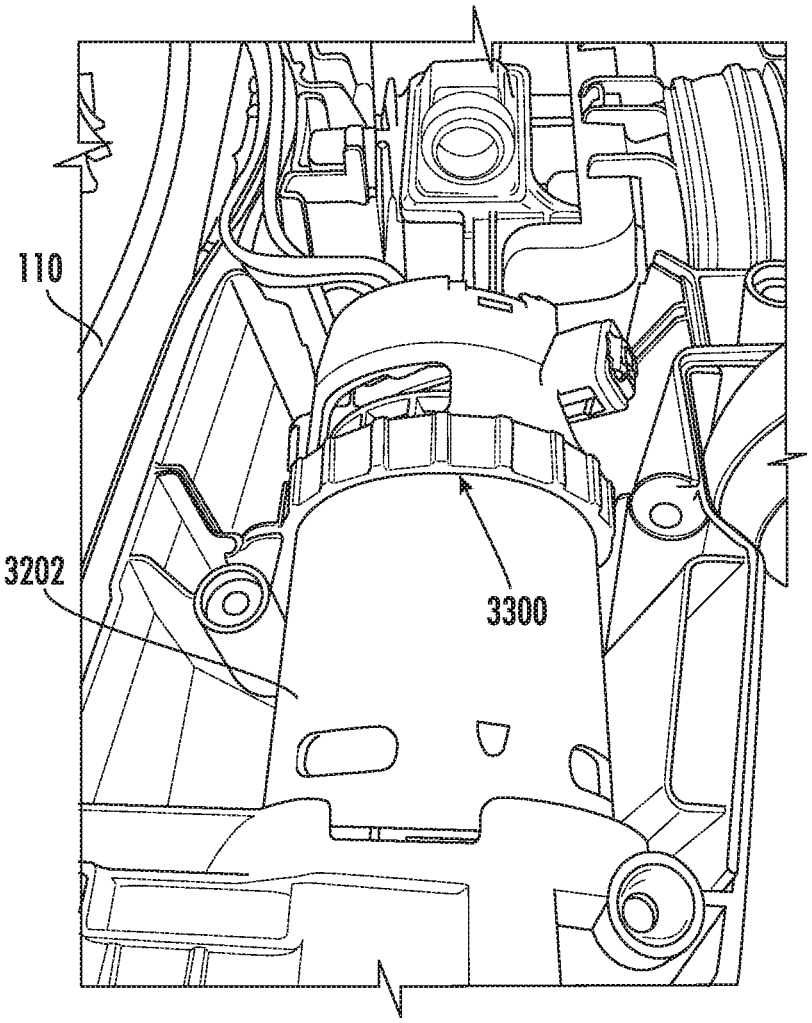
FIG. 33 generally illustrates one example of a motor support isolators consistent with the present disclosure.

With reference to FIGS. 32-33, the present disclosure may include one or more motor isolators 3200 (FIG. 32) and/or motor support isolators 3300 (FIG. 33). The motor isolators 3200 and motor support isolators 3300 may be disposed at least partially between a motor 3202 and a portion of the frame and/or housing 110 of the surface cleaning head 100. In the illustrated example, the motor 3202 may include an agitator motor configured to rotate one or more agitators 122, 124. For example, the motor 3202 may include a drive shaft 3204 and drive gear 3206 coupled to the agitator 122, 124 by way of a gear train and/or belt 3208. Of course, this is merely an example and the present disclosure is not limited to this example unless specifically claimed.

The motor isolators 3200 and motor support isolators 3300 may be at least partially formed from a material configured to absorb vibration caused by rotation of the motor 3202 and convert the vibrational energy into heat, thereby reducing the transfer of vibrational energy to the surface cleaning head 100. In at least one example, the motor isolators 3200 and motor support isolators 3300 may be formed, at least in part, from an elastomeric material. Non-limiting examples of elastomeric materials include polyvinyl chloride (PVC), rubber (both natural and synthetic), silicone, and the like. The elastomeric materials may have a shore hardness of 30 to 90. For example, the motor isolators 3200 and motor support isolators 3300 may be formed from a PVC having a shore hardness of 30 to 90 such as, but not limited to, a shore hardness of 50, 70, and/or 85, including all ranges therein.

The motor isolators 3200, FIG. 32, may be secured at least partially between the motor 32 and the frame/housing 110 in any manner known to those skilled in the art. By way of a non-limiting example, motor isolators 3200 may be secured in any manner similar to those described herein with respect to the combing isolators 500. For example, motor 3202 may be secured to the frame/housing 110 using one or more fasteners (not shown) and one or more rubberized grommet 3210.

The motor support isolators 3300, FIG. 33, may be disposed between the motor 3202 and the frame and/or housing 110. In at least one example, the motor support isolators 3300 may form an annular ring or the like extending around a perimeter of the motor 3200; however, it should be appreciated that the motor support isolators 3300 may extend about only a portion of the motor 3200.

Figure 34:
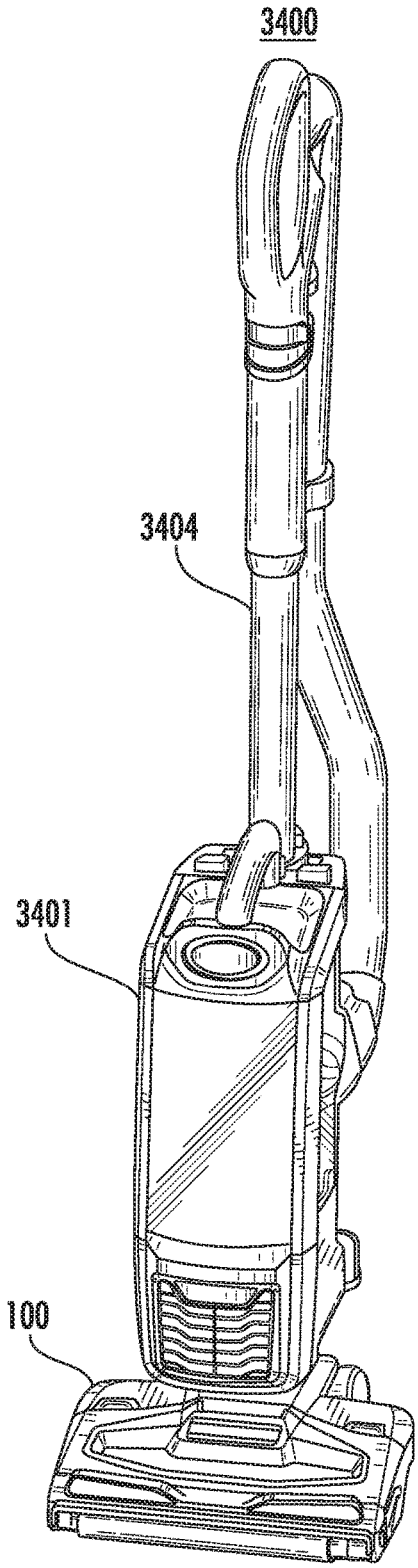
FIG. 34 generally illustrates one example of a cleaning apparatus that may include a surface cleaning head, consistent with the present disclosure.
Figure 35:
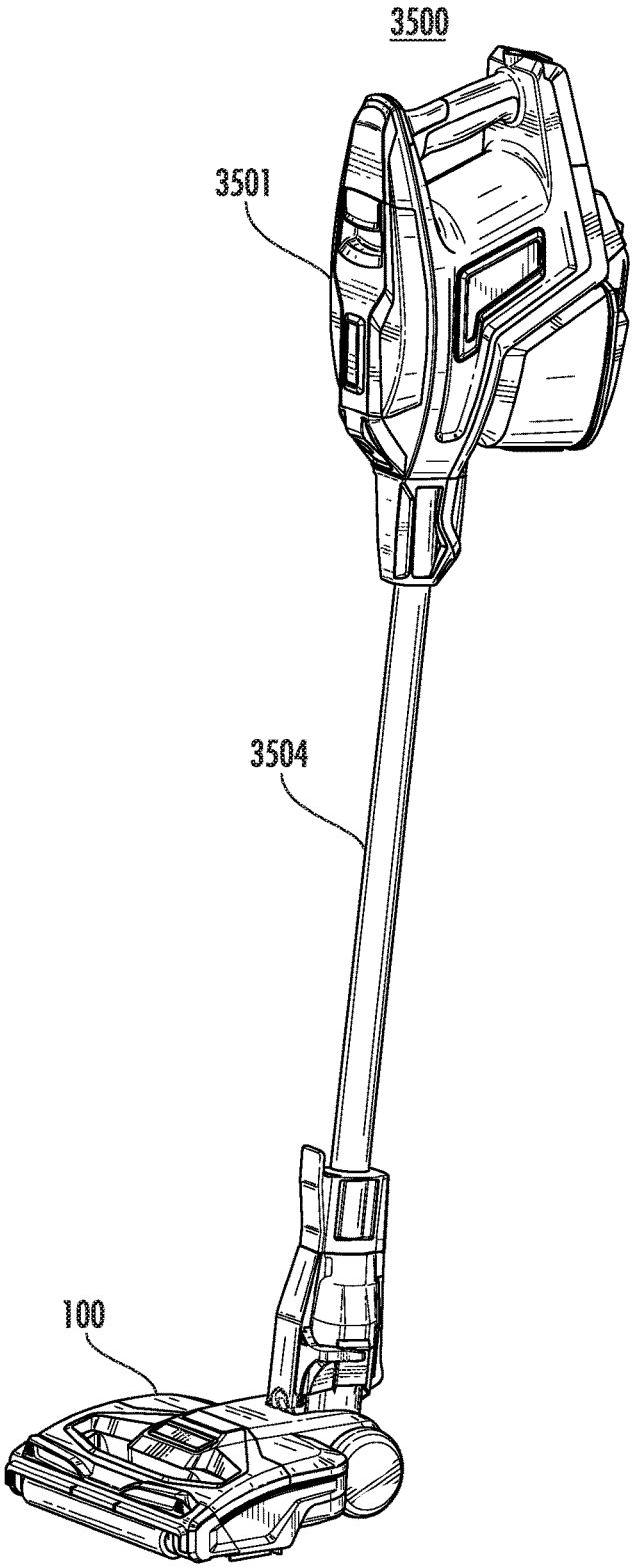
FIG. 35 generally illustrates another example of a cleaning apparatus that may include a surface cleaning head, consistent with the present disclosure.

The surface cleaning head 100 described herein may be part of any type of cleaning apparatus. For example, FIGS. 34 and 35 illustrate examples of two different types of cleaning apparatuses 3400, 3500 that may include a surface cleaning head 100, consistent with the embodiments described herein. A surface cleaning head 100 may be used on an upright vacuum cleaner 3400 with a removable canister 3401 coupled to a wand 3404, such as the type described in U.S. Patent Application Pub. No. 2015/0351596, which is commonly owned and fully incorporated herein by reference. A surface cleaning head 100 may be used on a stick type vacuum cleaner 3500 with a removable handheld vacuum 3501 coupled at one end of a wand 3504, such as the type described in U.S. Patent Application Pub. No. 2015/0135474, which is commonly owned and fully incorporated herein by reference.

Figure 36:
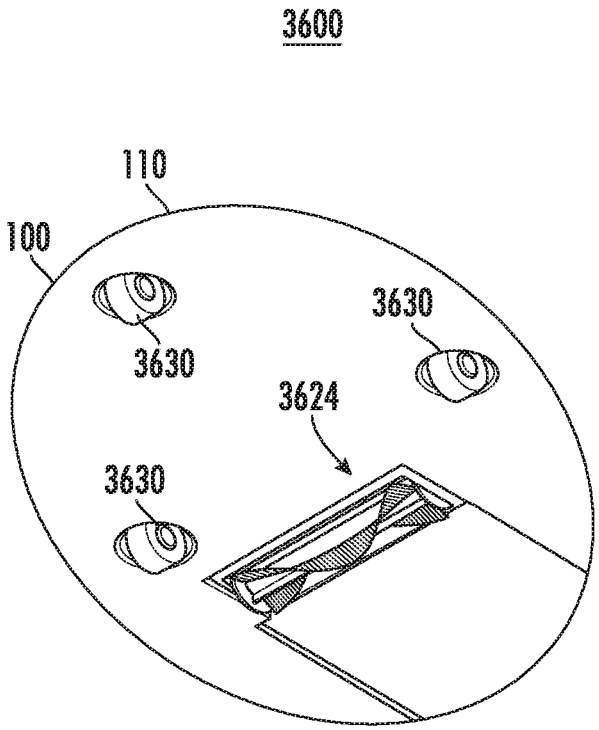
FIG. 36 generally illustrates a robotic vacuum cleaner forming a surface cleaning head including a housing and a cleaning roller with a combing unit, consistent with the present disclosure.

FIG. 36 illustrates a robotic vacuum cleaner 3600 forming a surface cleaning head 100 including a housing 110 and a cleaning roller 3624 with a combing unit (not shown) as disclosed herein. The robotic vacuum cleaner 3600 may also include one or more wheels 3630 for moving about a surface to be cleaned. An example of the combing unit used in a robotic vacuum cleaner is disclosed in greater detail in U.S. Provisional Application No. 62/469,853, filed Mar. 10, 2017, which is incorporated herein by reference.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A cleaning apparatus comprising:

a surface cleaning head including an agitation chamber configured to at least partially receive a rotating agitator therein;

a combing unit configured to be disposed at least partially within said agitation chamber, said combing unit including at least one combing protrusion configured to extend towards said agitator as said agitator rotates; and at least one combing isolator disposed at least partially between said combing unit and said surface cleaning head, said combing isolator including an elastomeric material configured to absorb mechanical vibration generated by contact between said agitator and said combing unit to reduce noise;

wherein a position of said combing unit is substantially fixed relative to said surface cleaning head as said agitator rotates.

2. The cleaning apparatus of claim 1, said combing unit including a series of spaced combing protrusions extending partially into said agitator.

3. The cleaning apparatus of claim 2, wherein said combing unit includes a ballast, said ballast is formed from a material denser than a material of spaced combing protrusions.

4. The cleaning apparatus of claim 1, wherein said surface cleaning head further includes a panel defining a portion of said agitation chamber, said panel configured to move between a closed position and an open position.

5. The cleaning apparatus of claim 4, wherein said combing isolator is disposed between said combing unit and said panel.

6. The cleaning apparatus of claim 4, wherein said combing unit comprising a back support and a plurality of spaced combing protrusions extending partially into said agitator, wherein said combing isolator is disposed between said back support and said panel.

7. The cleaning apparatus of claim 4, wherein said panel is removably coupled to a housing of said surface cleaning head.

8. The cleaning apparatus of claim 4 wherein said panel is coupled to a housing of said surface cleaning head with at least one hinge.

9. The cleaning apparatus of claim 1, wherein said surface cleaning head includes a housing defining at least a portion of said agitation chamber, and wherein said combing isolator is disposed between said combing unit and said housing.

10. A surface cleaning head comprising:

a housing defining an opening on an underside of the housing and defining a portion of an agitation chamber;

a panel defining another portion of said agitation chamber, said panel configured to move between a closed position and an open position;

an agitator configured to rotate within said agitation chamber;

a combing unit configured to be disposed at least partially within said agitation chamber, said combing unit including at least one combing protrusion configured to extend towards said agitator as said agitator rotates; and a panel isolator disposed at least partially between said housing and said panel, said panel isolator including an elastomeric material configured to absorb mechanical vibration generated by contact between said agitator and said combing unit to reduce noise;

wherein a position of said combing unit is substantially fixed relative to said housing as said agitator rotates.

11. The surface cleaning head of claim 10, said combing unit including a series of spaced combing protrusions extending partially into said agitator.

12. The surface cleaning head of claim 10, wherein said panel is removably coupled to said housing of said surface cleaning head.

13. The surface cleaning head of claim 10, wherein said panel is coupled to said housing of said surface cleaning head with at least one hinge.

14. The surface cleaning head of claim 10, further comprising at least one combing isolator disposed at least partially between said combing unit and panel, said combing isolator configured to absorb mechanical vibration generated by contact between said agitator and said combing unit to reduce noise.

15. The surface cleaning head of claim 10, wherein said combing unit includes a ballast, said ballast is formed from a material denser than a material of spaced combing protrusions.

16. A surface cleaning head comprising:

a housing defining an opening on an underside of the housing and defining a portion of an agitation chamber;

a panel defining another portion of said agitation chamber, wherein said panel is configured to move between a closed position and an open position and comprises a panel frame and a window;

an agitator configured to rotate within said agitation chamber;

a combing unit configured to be disposed at least partially within said agitation chamber, said combing unit including at least one combing protrusion extending partially into said agitator; and a panel isolator disposed between said panel frame and said window, said panel isolator including an elastomeric material configured to absorb mechanical vibration generated by contact between said agitator and said combing unit to reduce noise.

17. The surface cleaning head of claim 16, wherein said window comprises at least partially transparent material.

18. A surface cleaning head comprising:

a housing defining an opening on an underside of the housing and defining a portion of an agitation chamber;

a panel defining another portion of said agitation chamber, wherein said panel is configured to move between a closed position and an open position and comprises a panel frame and a window;

an agitator configured to rotate within said agitation chamber;

a combing unit configured to be disposed at least partially within said agitation chamber, said combing unit including at least one combing protrusion extending partially into said agitator; and a panel isolator disposed between said panel frame and said housing, said panel isolator including an elastomeric material configured to absorb mechanical vibration generated by contact between said agitator and said combing unit to reduce noise.

* * * * *